US007323629B2

(12) United States Patent
Somani et al.

(10) Patent No.: US 7,323,629 B2
(45) Date of Patent: Jan. 29, 2008

(54) REAL TIME MUSIC RECOGNITION AND DISPLAY SYSTEM

(76) Inventors: Arun Somani, 2445 Ridgetop Cr. 50014, Ames, IA (US) 50014; Wu Tao, Room 128H, University Village, Ames, IA (US) 50010; Raed Adhami, 721 Crawford Ave., Ames, IA (US) 50010; Liang Zhao, 6100 Westchester Park Dr. #512, College Park, MD (US) 20740; Anil Sahai, 709 White Post Dr., Webster City, IA (US) 50595

( * ) Notice: Subject to any disclaimer, the term of this patent is extended or adjusted under 35 U.S.C. 154(b) by 335 days.

(21) Appl. No.: 10/622,083

(22) Filed: Jul. 16, 2003

(65) Prior Publication Data

US 2005/0015258 A1 Jan. 20, 2005

(51) Int. Cl.
*G10H 1/00* (2006.01)

(52) U.S. Cl. ..... 84/470 R; 84/475; 84/477 R; 700/94

(58) Field of Classification Search ..... 700/94; 84/470 R, 475, 477 R, 603
See application file for complete search history.

(56) References Cited

U.S. PATENT DOCUMENTS 4,633,748 A * 1/1987 Takashima et al. ..... 84/603
6,156,964 A 12/2000 Sahai et al.
6,380,474 B2 * 4/2002 Taruguchi et al. ..... 84/612
6,417,435 B2 * 7/2002 Chantzis et al. ..... 84/477 R
6,541,691 B2 * 4/2003 Tolonen et al. ..... 84/616
6,725,108 B1 * 4/2004 Hall ..... 700/94
6,737,572 B1 * 5/2004 Jameson et al. ..... 84/741
6,967,275 B2 * 11/2005 Ozick ..... 84/616
2001/0029830 A1 * 10/2001 Rosen ..... 84/478
2002/0005109 A1 * 1/2002 Miller ..... 84/609
2003/0024375 A1 * 2/2003 Sitrick ..... 84/477 R
2004/0069128 A1 * 4/2004 Ludwig ..... 84/645
2004/0194610 A1 * 10/2004 Davis ..... 84/466

OTHER PUBLICATIONS

Geçkinli, Nezih C., et al., "Algorithm for Pitch Extraction Using Zero-Crossing Interval Sequence", *IEEE Transactions on Acoustics, Speech, and Signal Processing*, vol. ASSP-25, No. 6, (Dec. 1997),559-564.

(Continued)

*Primary Examiner*—Lincoln Donovan
*Assistant Examiner*—David S. Warren
(74) *Attorney, Agent, or Firm*—Schwegman, Lundberg & Woessner P.A.

(57) ABSTRACT

Systems and methods for performing simple and quick real time single music note recognition algorithm based on fuzzy pattern matching are disclosed. In one aspect, the systems and methods use a 256-point FFT and fuzzy pattern identification and recognition method. The systems and methods can recognize a note as short as 0.125 seconds in a frequency range from 16 Hz to 4000 Hz, with 11.025 KHz sampling rate and 8-bit per sampling signal. The systems and methods may be used as part of a music tutor system that receives a played note, identifies the played note, and compares the played note with a reference note. An indication may be given as to whether the played note matched the reference note.

61 Claims, 14 Drawing Sheets

OTHER PUBLICATIONS

Justice, James H., "Analytic Signal Processing in Music Composition", *IEEE Transactions on Acoustics, Speech, and Signal Processing*, vol. ASSP-27, No. 6, (Dec. 1979),670-684.

Kashino, Kunio , et al., "A Music Scene Analysis System With the MRF-Based Information Integration System", *Proceedings of the 13th Annual Conference on Pattern Recognition* (*ICPR '96*), vol. 2, (1996),725-729.

Kitazume, Yoshiaki, et al., "LSI Implementation of a Pattern Matching Algorithm for Speech Recognition", *IEEE Transactions on Acoustics, Speech, and Signal Processing*, vol. ASSP-33, No. 1, (Feb. 1985),1-4.

Kuhn, William B., "A Real-Time Pitch Recognition Algorithm for Music Applications", *Computer Music Journal*, 14(3), (Fall, 1990),60-71.

Moorer, James A., "On the Transcription of Musical Sound by Computer", *Computer Music Journal*, 1(4), (Nov. 1977),32-38.

Niederjohn, Russell J., "A Mathematical Formulation and Comparison of Zero-Crossing Analysis Techniques Which Have Been Applied to Automatic Speech Recognition", *IEEE Transactions on Acoustics, Speech, and Signal Processing*, vol. ASSP-23, No. 4, (Aug. 1975),373-380.

O'Shaughnessy, Douglas , "Speaker Recognition", *IEEE ASSP Magazine*, 3(4)(Part 1), (Oct. 1986),4-17.

Picone, Joseph , "Continuous Speech Recognition Using Hidden Markov Models", *IEEE ASSP Magazine*, 7(3), (Jul. 1990),26-41.

Sano, Hajime, et al., "A Neural Network Model for Pitch Perception", *Computer Music Journal*, 13(3), (Fall, 1989),41-48.

Silverman, Harvey F., et al., "The Application of Dynamic Programming to Connected Speech Recognition", *IEEE ASSP Magazine*, 7(3), (Jul. 1990),6-25.

Tucker, Warren H., et al., "A Pitch Estimation Algorithm for Speech and Music", *IEEE Transactions on Acoustics, Speech, and Signal Processing*, vol. ASSP-26, No. 6, (Dec. 1978),597-604.

* cited by examiner

```
note {
        measure;
        flat;
        sharp ;
        pitch;
        duration;
        color;
        position;
}
```

602

REAL TIME MUSIC RECOGNITION AND DISPLAY SYSTEM

FIELD

The present invention relates generally to computer systems, and more particularly to systems that recognize and display music.

COPYRIGHT NOTICE/PERMISSION

A portion of the disclosure of this patent document contains material that is subject to copyright protection. The copyright owner has no objection to the facsimile reproduction by anyone of the patent document or the patent disclosure as it appears in the Patent and Trademark Office patent file or records, but otherwise reserves all copyright rights whatsoever. The following notice applies to the software and data as described below and in the drawings hereto: Copyright © 2003, Iowa State University Research Foundation, Inc. All Rights Reserved.

BACKGROUND

It typically takes much practice in order to become proficient at playing a musical instrument. Currently, most musicians practice or perform musical instruments from sheet music or music books. The sheet music or music books are typically placed on a music stand in front of the players. However, it has long been noticed that traditional sheet music causes storage and handling problems. A musical library is normally needed to store the music books. The paper on which music is printed wears out quickly after frequent use. Once the pages of music become frayed or torn, the music becomes difficult to read, and it is even sometimes illegible. Furthermore, the musician practicing the instrument must periodically stop playing to turn the pages, which can interrupt his or her performance. Also, human error is unavoidable. For example, two or more pages may be turned at one time or no page may be turned when one is required.

An additional problem is that a practicing musician does not get feedback until they meet with their instructor. In the mean time, the musician may not be playing notes correctly.

As a result, there is a need in the art for the present invention.

DETAILED DESCRIPTION

In the following detailed description of exemplary embodiments of the invention, reference is made to the accompanying drawings which form a part hereof, and in which is shown by way of illustration specific exemplary embodiments in which the invention may be practiced. These embodiments are described in sufficient detail to enable those skilled in the art to practice the invention, and it is to be understood that other embodiments may be utilized and that logical, mechanical, electrical and other changes may be made without departing from the scope of the present invention.

Some portions of the detailed descriptions which follow are presented in terms of algorithms and symbolic representations of operations on data bits within a computer memory. These algorithmic descriptions and representations are the ways used by those skilled in the data processing arts to most effectively convey the substance of their work to others skilled in the art. An algorithm is here, and generally, conceived to be a self-consistent sequence of steps leading to a desired result. The steps are those requiring physical manipulations of physical quantities. Usually, though not necessarily, these quantities take the form of electrical or magnetic signals capable of being stored, transferred, combined, compared, and otherwise manipulated. It has proven convenient at times, principally for reasons of common usage, to refer to these signals as bits, values, elements, symbols, characters, terms, numbers, or the like. It should be borne in mind, however, that all of these and similar terms are to be associated with the appropriate physical quantities and are merely convenient labels applied to these quantities. Unless specifically stated otherwise as apparent from the following discussions, terms such as "processing" or "computing" or "calculating" or "determining" or "displaying" or the like, refer to the action and processes of a computer system, or similar computing device, that manipulates and transforms data represented as physical (e.g., electronic) quantities within the computer system's registers and memories into other data similarly represented as physical quantities within the computer system memories or registers or other such information storage, transmission or display devices.

In the Figures, the same reference number is used throughout to refer to an identical component which appears in multiple Figures. Signals and connections may be referred to by the same reference number or label, and the actual meaning will be clear from its use in the context of the description.

The following detailed description is, therefore, not to be taken in a limiting sense, and the scope of the present invention is defined only by the appended claims.

OPERATING ENVIRONMENT

Figure 1A:
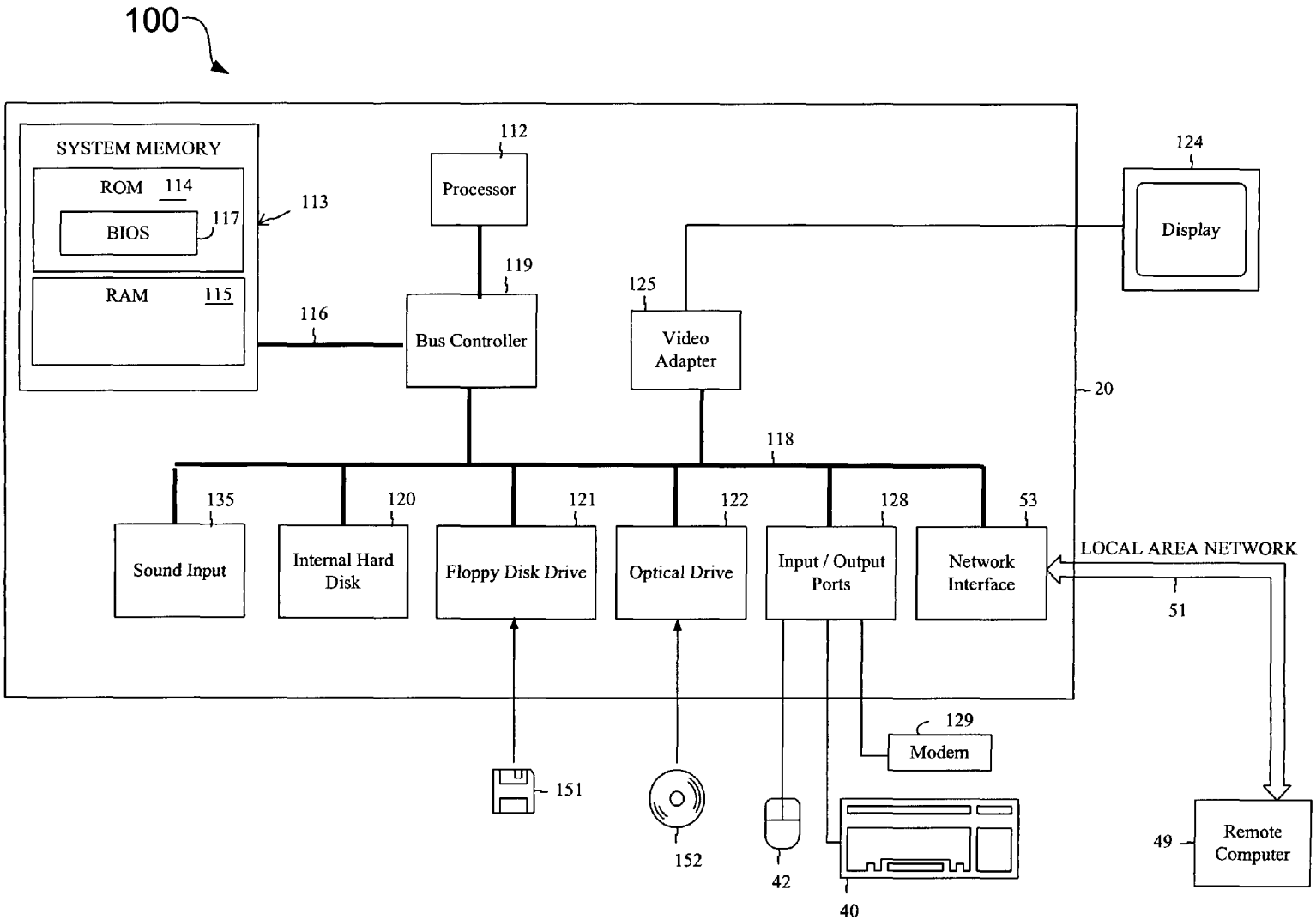
FIG. 1A is a block diagram of personal computer hardware and operating environment in which different embodiments of the invention can be practiced.

FIG. 1A is a diagram of the hardware and operating environment in conjunction with which embodiments of the invention may be practiced. The description of FIG. 1A is intended to provide a brief, general description of suitable computer hardware and a suitable computing environment in conjunction with which the invention may be implemented.

Although not required, the invention is described in the general context of computer-executable instructions, such as program modules, being executed by a computer, such as a personal computer or a server computer. Generally, program modules include routines, programs, objects, components, data structures, etc., that perform particular tasks or implement particular abstract data types.

Moreover, those skilled in the art will appreciate that the invention may be practiced with other computer system configurations, including hand-held devices, multiprocessor systems, microprocessor-based or programmable consumer electronics, network PCs, minicomputers, mainframe computers, and the like. The invention may also be practiced in distributed computing environments where tasks are performed by remote processing devices that are linked through a communications network. In a distributed computing environment, program modules may be located in both local and remote memory storage devices.

As shown in FIG. 1A, the computing system 100 includes a processor 112. The invention can be implemented on computers based upon microprocessors such as the PENTIUM® family of microprocessors manufactured by the Intel Corporation, the MIPS® family of microprocessors from the Silicon Graphics Corporation, the POWERPC® family of microprocessors from both the Motorola Corporation and the IBM Corporation, the PRECISION ARCHITECTURE® family of microprocessors from the Hewlett-Packard Company, the SPARC® family of microprocessors from the Sun Microsystems Corporation, or the ALPHA® family of microprocessors from the Compaq Computer Corporation. Computing system 100 represents any personal computer, laptop, server, or even a battery-powered, pocket-sized, mobile computer known as a hand-held PC.

The computing system 100 includes system memory 113 (including read-only memory (ROM) 114 and random access memory (RAM) 115), which is connected to the processor 112 by a system data/address bus 116. ROM 114 represents any device that is primarily read-only including electrically erasable programmable read-only memory (EEPROM), flash memory, etc. RAM 115 represents any random access memory such as Synchronous Dynamic Random Access Memory.

Within the computing system 100, input/output bus 118 is connected to the data/address bus 116 via bus controller 119. In one embodiment, input/output bus 118 is implemented as a standard Peripheral Component Interconnect (PCI) bus. The bus controller 119 examines all signals from the processor 112 to route the signals to the appropriate bus. Signals between the processor 112 and the system memory 113 are merely passed through the bus controller 119. However, signals from the processor 112 intended for devices other than system memory 113 are routed onto the input/output bus 118.

Various devices are connected to the input/output bus 118 including hard disk drive 120, floppy drive 121 that is used to read floppy disk 151, and optical drive 122, such as a CD-ROM drive that is used to read an optical disk 152 and a sound input device 135 such as a sound card. In some embodiments, sound input device 135 includes a built-in A/D converter to convert analog musical waveforms to digital data. Inputs to sound input device 135 may include microphone input and MIDI input.

The video display 124 or other kind of display device is connected to the input/output bus 118 via a video adapter 125.

A user enters commands and information into the computing system 100 by using a keyboard 40 and/or pointing device, such as a mouse 42, which are connected to bus 118 via input/output ports 128. Other types of pointing devices (not shown in FIG. 1A) include track pads, track balls, joy sticks, data gloves, head trackers, and other devices suitable for positioning a cursor on the video display 124.

As shown in FIG. 1A, the computing system 100 also includes a modem 129. Although illustrated in FIG. 1A as external to the computing system 100, those of ordinary skill in the art will quickly recognize that the modem 129 may also be internal to the computing system 100. The modem 129 is typically used to communicate over wide area networks (not shown), such as the global Internet. The computing system may also contain a network interface card 53, as is known in the art, for communication over a network.

Software applications and data are typically stored via one of the memory storage devices, which may include the hard disk 120, floppy disk 151, CD-ROM 152 and are copied to RAM 415 for execution. In one embodiment, however, software applications are stored in ROM 114 and are copied to RAM 115 for execution or are executed directly from ROM 114.

In general, an operating system executes software applications and carries out instructions issued by the user. For example, when the user wants to load a software application, the operating system interprets the instruction and causes the processor 112 to load software application into RAM 115 from either the hard disk 120 or the optical disk 152. Once a software application is loaded into the RAM 115, it can be used by the processor 112. In case of large software applications, processor 412 may load various portions of program modules into RAM 115 as needed. The operating system may be any of a number of operating systems known in the art, for example the operating system may be one of Windows® 95, Windows 98®, Windows® NT, Windows 2000® Windows ME® and Windows XP® by Microsoft, or it may be a UNIX based operating system such as Linux, AIX, Solaris, and HP/UX. The invention is not limited to any particular operating system.

The Basic Input/Output System (BIOS) 117 for the computing system 100 is stored in ROM 114 and is loaded into RAM 115 upon booting. Those skilled in the art will recognize that the BIOS 117 is a set of basic executable routines that have conventionally helped to transfer information between the computing resources within the computing system 100. These low-level service routines are used by the operating system or other software applications.

Figure 1B:
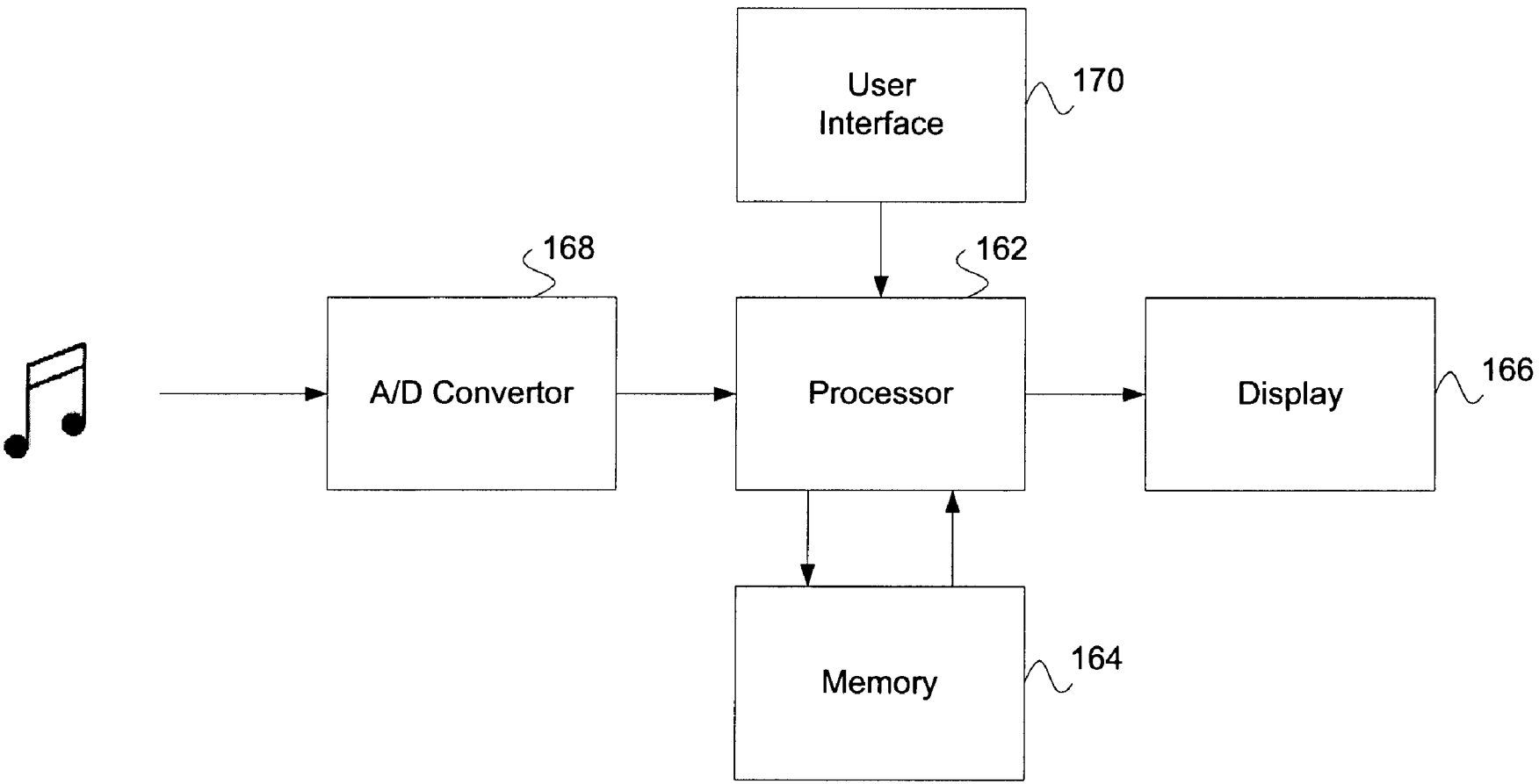
FIG. 1B is a block diagram of an alternative computer hardware and operating environment according to embodiments of the invention.

FIG. 1B is a block diagram of an alternative computer hardware and operating environment 160 according to embodiments of the invention. The hardware environment described in FIG. 1B is representative of hardware that may be included in a stand-alone music recognition and display system, a portable music recognition and display system, or an embedded single board controller.

In some embodiments, the system includes A/D (Analog to Digital) converter 168, processor 162, memory 164 and display 166. Numerous A/D converters are available and know in the art. In some embodiments, A/D converter 168 is capable of sampling at 11.025 KHz with 8-bits of data provided per sample. In some embodiments, a microphone may be coupled to A/D converter 168.

Processor 162 may be any type of computer processor. It is desirable that processor 162 operates at speeds fast enough to sample the musical information in musically insignificant time units, normally milliseconds. In some embodiments, processor 162 is a MCS8031/51 processor.

Memory 164 may include any combination of one or more of RAM, ROM, CD-ROM, DVD-ROM, hard disk, or a floppy disk.

In some embodiments, display 166 is an LCD (Liquid Crystal Display). There are numerous LCD boards having numerous screen resolutions available to those of skill in the art. In some embodiments, an LCD with 240 by 128 pixels is used. Such LCDs are available from Data International Co.

User interface 170 may be used to control the operation of the system described above. In some embodiments, the user interface 170 provides a means for communication between the machine and a user. The user interface 170 may be used to select a particular score from memory 164. The user interface 170 may also allow a user to select certain function to be performed by the system, such as music composing or music accompaniment.

In operation, system 160 may perform various functions. For example, system 160 may be used for musical score processing, musical digital signal processing, musical accompaniment, and display control. The score processing function of system 160 converts a music score file in memory 164 into a data structure that can be easily manipulated by system 160. In addition, the score processing may extract the musical information from the file, and assign display attributes to the score. After the score processing, a stream of notes can be stored in memory 164. Real-time musical notes may come through a microphone coupled to A/D converter 168. Musical digital signal processing performed by processor 162 obtains the digital musical information from the A/D converter 168, transfers the information from the time domain to the frequency domain by using FFT as described below, and then obtains pitch and timing information of a note. The music accompaniment compares the incoming notes with the notes stored in a database in memory 164 to determine which note or notes were played. The result is shown on display 166.

Figure 2:
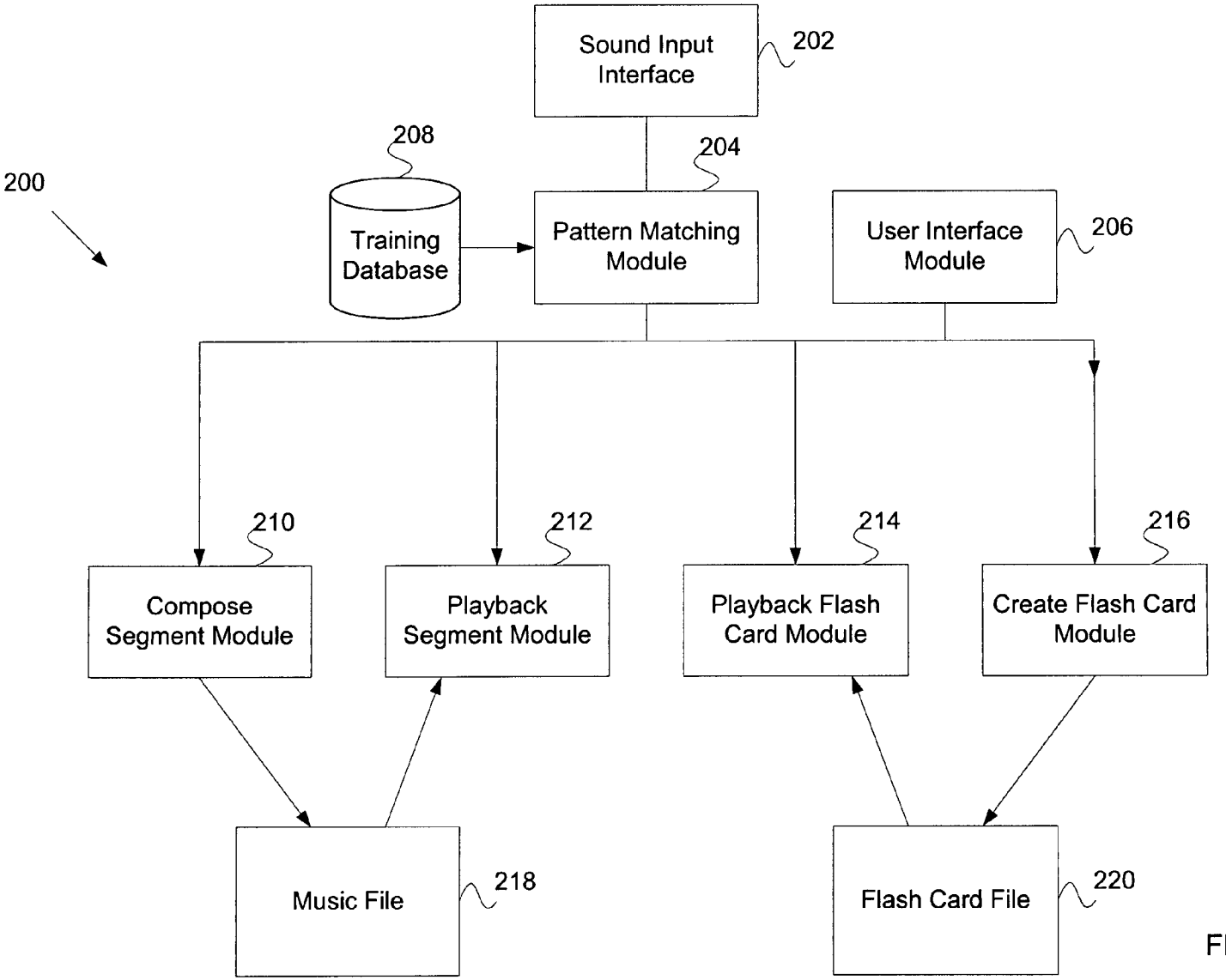
FIG. 2 is a diagram providing illustrating the major components of a system according to an embodiment of the invention.

FIG. 2 is a diagram providing illustrating the major components of a software system 200 according to embodiments of the invention. In some embodiments, system 200 includes a sound input interface 202, a pattern matching module 204, a user interface module 206, a training database 208 a compose segment module 210, a playback segment module 212, a playback flash card module 214, and a create flash card module 216. However, not all embodiments of the invention require all of the above-mentioned components. The components of system 200 may be executed by the systems described above in FIGS. 1A and 1B.

User interface module 206 may be used to control the operation of the system, and in particular may be used to determine which of modules 210-216 are to be executed.

Sound input interface 202 provides a software interface to one or more sound input devices. Various types of sound input devices are may be incorporated in various embodiments of the invention. Examples of such sound input interfaces include a software interface to a sound card connected to a microphone, a scanner software interface able to read an interpret sheet music, a MIDI (Musical Instrument Digital Interface) device software interface, and a keyboard interface.

For a computer to correctly interpret audio information, the information must typically be formatted in a specific layout. Based on this defined format computer can be programmed to read and write audio information. Several file formats including MIDI, MP3, WAV and SND formats are used to store audio information. As is known in the art, MIDI was developed provide a standard allowing electronic instruments, performance controllers, computers, and other related devices to communicate with one another. An advantage of a MIDI file is comparatively small size. A 15 MB MIDI file might produce more than three minutes of music. By contrast, the same size of WAV file typically lasts less than two seconds. Today, many musical instruments and devices are designed and manufactured as MIDI compatible to ease the communication within a connected musical system. Various embodiments of the invention may be MIDI compatible. These embodiments may read in MIDI file and then translate it to a file format that is being used within the system and including the data structures illustrated below in FIGS. 6A and 6B.

Pattern matching module 204 may be used to compare a note feature received from sound input interface 202 with musical notes stored in the database and determine a most likely matching note from the database. Pattern matching may also be referred to as feature matching. In some embodiments, the pattern matching module 204 may be used to find a note feature in the database which has a minimum variation from the received note feature, as compared to other notes in the database. Further, in some embodiments, the pattern matching described below with reference to FIG. 3B may be used. It should be noted that effects such as reverb or sustain applied to the input musical note may reduce accuracy of the pattern matching. Further, it is typically desirable that if using a keyboard or other electronic input device, to set the instrument volume at a high setting, and to set the system microphone volume on a low setting.

Figure 4A:
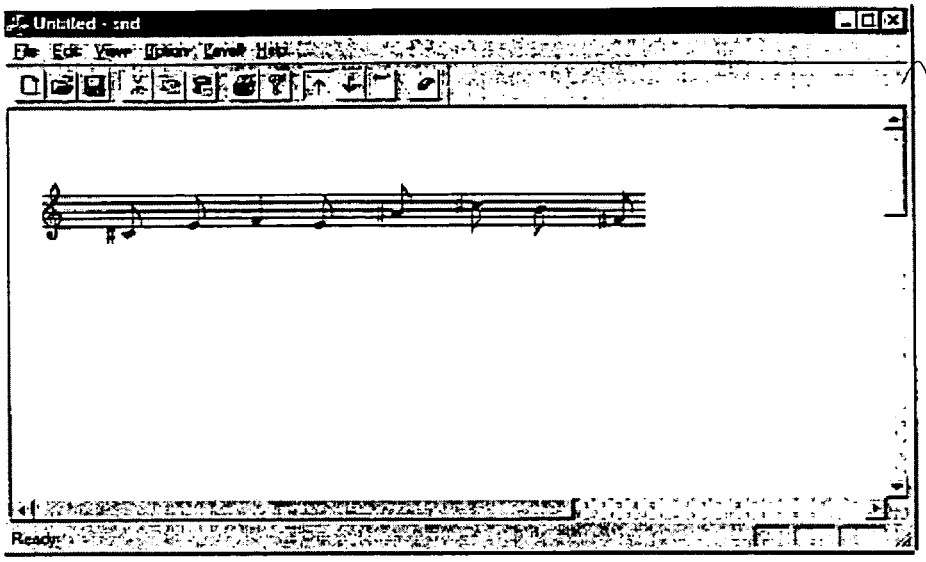
FIGS. 4A-4F are illustrations of a user interface according to an embodiment of the invention.
Figure 4B:
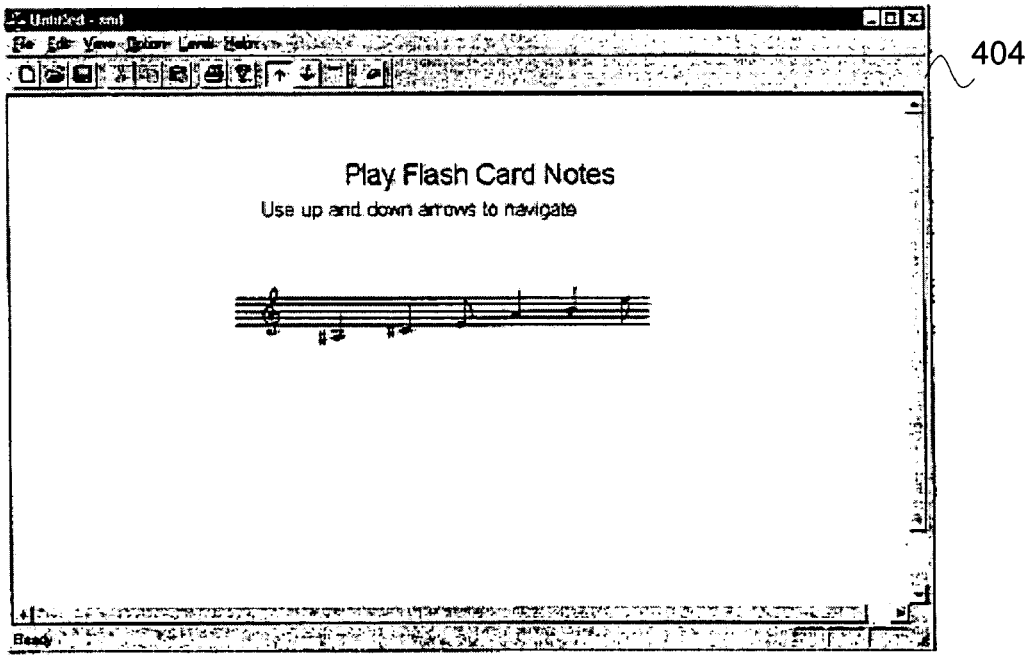

Compose segment module 210 provides a means for a user to write their own music. For example, a teacher or a musician may enter musical segments in the database 208. When executed, the compose segment module initializes in order to compose a new music segment such as a music score. After initialization, each note identified by the input interface and pattern matching module is sent to the music display program. The system treats the identified notes as a stream of notes. After composition, the music can be saved into a music (.mus) file 218. Additionally, in some embodiments, the system automatically divides the note stream into measures. The user can open the saved file later to read, practice, or playback their creation. In some embodiments, a refresh button may be provided so that the creator can discard all the notes anytime he wants to start over. FIG. 4A provides an illustration of an exemplary user interface screen 402 according to an embodiment of the invention. The exemplary screen illustrates a stream of notes recognized by the system.

Playback segment module 210 allows a user to load previously created musical segments from a music file 218 to the system, and play them back. For a computer to follow a musician, a pre-stored music segment must be opened first. After the segment is opened, the sound input device (e.g. a microphone) will receive the notes and the system will make the comparison between the incoming note and the first un-played note on the segment. The same refresh button used in the music composition part may be used to restore the score to its original ready-to-play status.

Figure 4C:
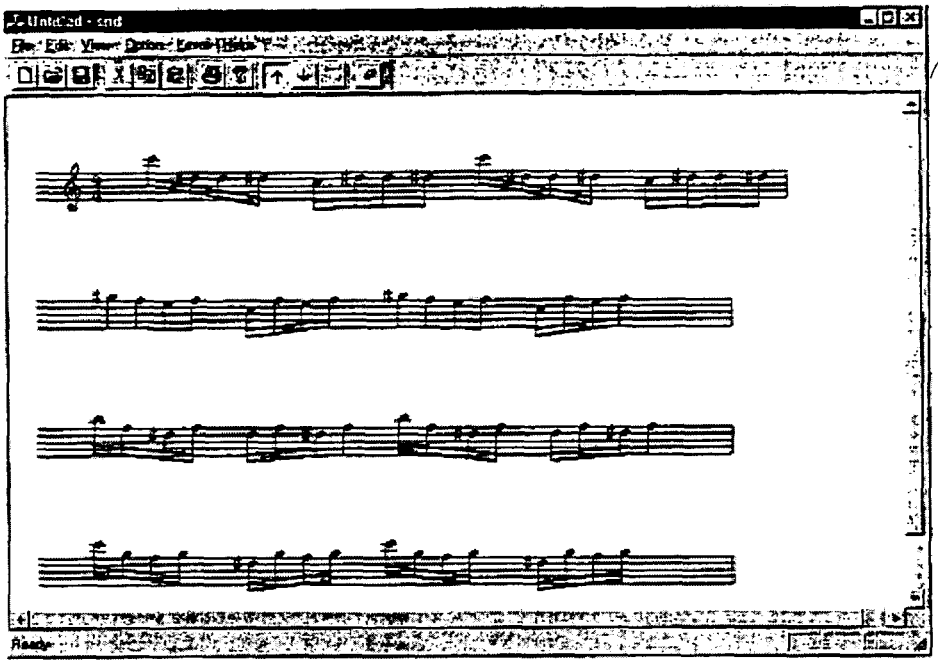

For a monophonic instrument, only the treble clef needs to be loaded. FIG. 4C illustrates an exemplary user interface screen 406 showing a single clef that has been loaded.

Figure 4D:
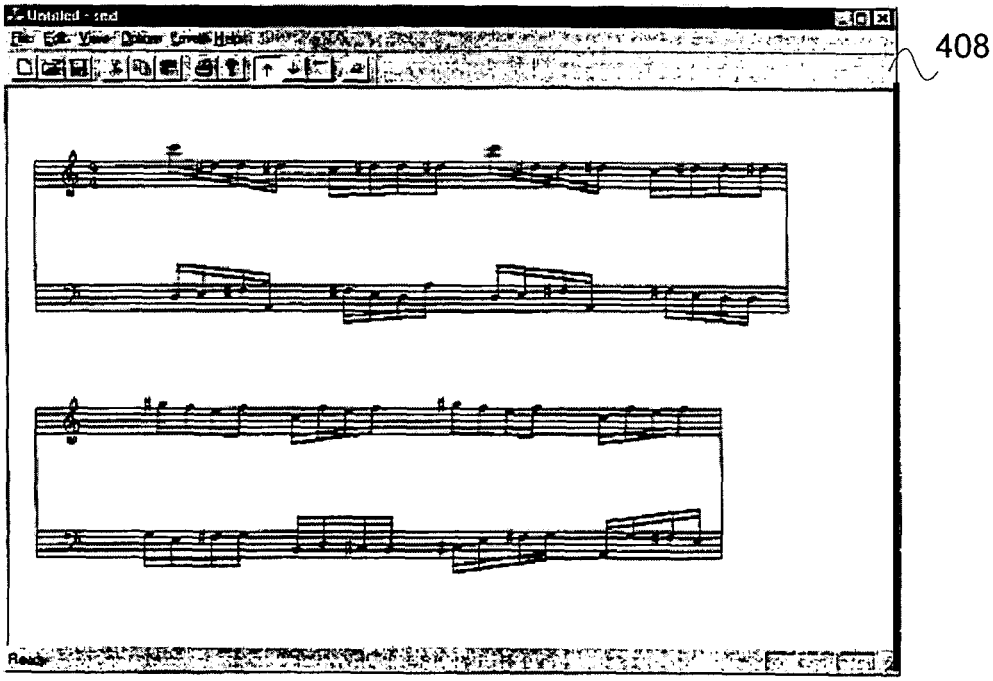

For a polyphonic instrument, both treble and bass clefs may be loaded. In some embodiments, the system will prompt a user to load the treble clef first, and then the bass clef. FIG. 4D is an illustration of an exemplary user interface screen 408 showing a score with both treble and bass clefs loaded.

In some embodiments, the user interface provides three buttons are designed to help the user to peruse the score. A click on the up arrow button will turn to the previous page. A click on the down arrow will turn to the next page. The left arrow is used to return to the first page. When opening a large file that doesn't entirely fit on the screen, the program will automatically divide it into several sections that fit on the screen. When replaying the file the program of some embodiments will automatically switch to the next section when the finished playing the previous section.

In alternative embodiments, there are three buttons on the top of the display, a down arrow, an up arrow and a back arrow. The down arrow takes the user to the next section, the up arrow takes the user to the previous section and, the back section takes the user back to the beginning of the file.

In some embodiments, as the system receives and recognizes notes played by a user, the system highlights notes played correctly in green, and notes played incorrectly in red. The criteria used to determine the correctness of a note may be adjusted by the user. In some embodiments, there are three different levels for music recognition accessible through a menu on the user interface. The first level, referred to as "beginner", will grade notes only on correctness of the note played. Beginner level is the lowest level. It checks only the pitch of the note without caring about the duration of the note. This means that as long as the pitch played at the position of the note is right, the note will be counted as a match. In some embodiments, when a user plays a note incorrectly, the program will keep getting input for that note until it is played correctly. Once that note is entered correctly, the system will continue on to the next note.

The second level referred to as "intermediate", will not pause on the note played incorrectly. It will go on to the next note, highlighting the incorrect note in red.

The third level, referred to as "advanced", works in a similar fashion to the intermediate level, with a difference of factoring in timing, as well as correctness. For example, a ⅛ note should be played in ⅛th time; or else it will be highlighted in red.

Furthermore, in some embodiments, the note color may be used to trace the current position on the screen during the user's performance. As noted above, three different colors may be used. Notes that are black comprise notes haven't been played yet. In these embodiments, when a new musical file is opened, all notes shown on the screen will be black. A note changes color only after that note has been played. If a new note sent from the sound board matches the note expected to be compared, the note color on the score will be changed to green. The color red is used to represent a miss played note. Thus the boundary between black color and other colors denotes the current position of the performance.

Figure 4E:
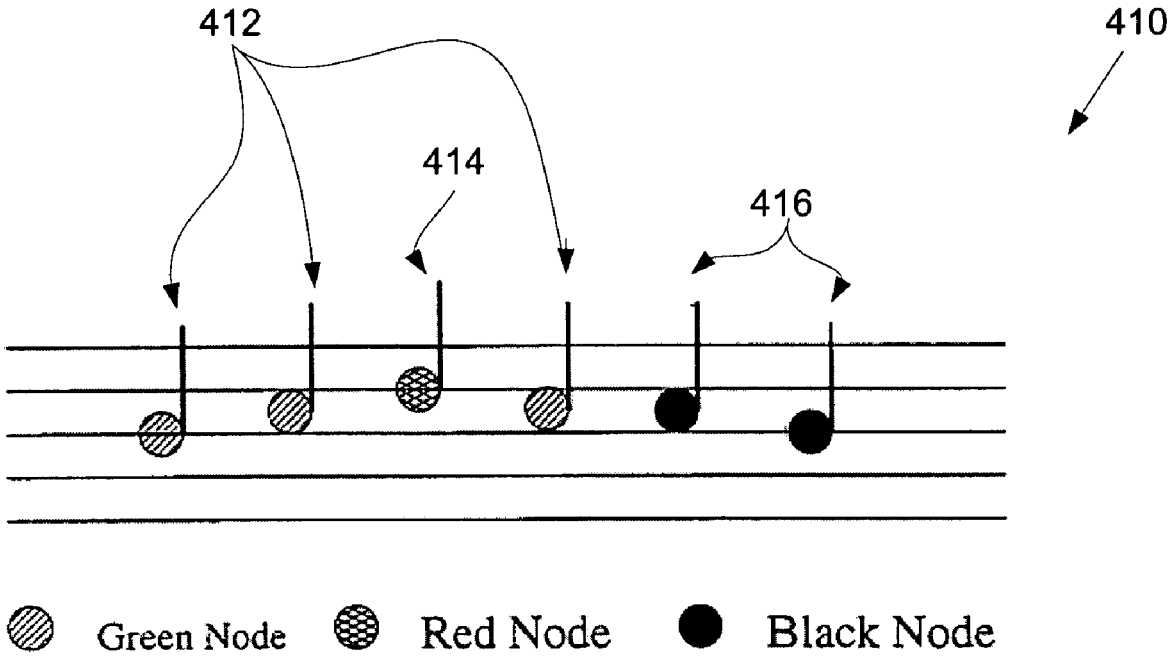

FIG. 4E provides an illustration of how the colors are used to display notes during the performance. In the example illustrated, there are green notes 412, red note 414, and black notes 416. As illustrated FIG. 4E, the first two notes are green, which means these notes are correctly played. The third note is an incorrectly played note, which is represented by red color. The fifth note, whose color is black, is the place the where performance left off and may be continued. When a new note arrives, the fifth note and the played note are compared to determine whether the user played a correct note not or not. The note color will then change to green or red accordingly.

Additionally, color may be used on a measure by measure basis in some embodiments. In these embodiments, the system recognizes notes and follows the performance measure by measure. The next page will be displayed when the performance reaches the end of the current page. A measure bar changes color from black to green when the performance continues to the next measure. By using the color information, a musician can tell which measure he is practicing.

Compose flash cards module 216 allows a user to create a series of exercises in a flash card like format. The user selects the compose flash card mode from user interface 206, then starts playing the first flash card. When done, he can either use a down arrow on the user interface to move on to the next card in the series, or save what has been already played. Similarly, by clicking Option Edit Flash Card prepares the system to create a new flash card. After composition, the notes can be saved into a flash card (.flc) file 220. In some embodiments, the flash card file 220 does not divide the notes into measures.

Figure 4F:
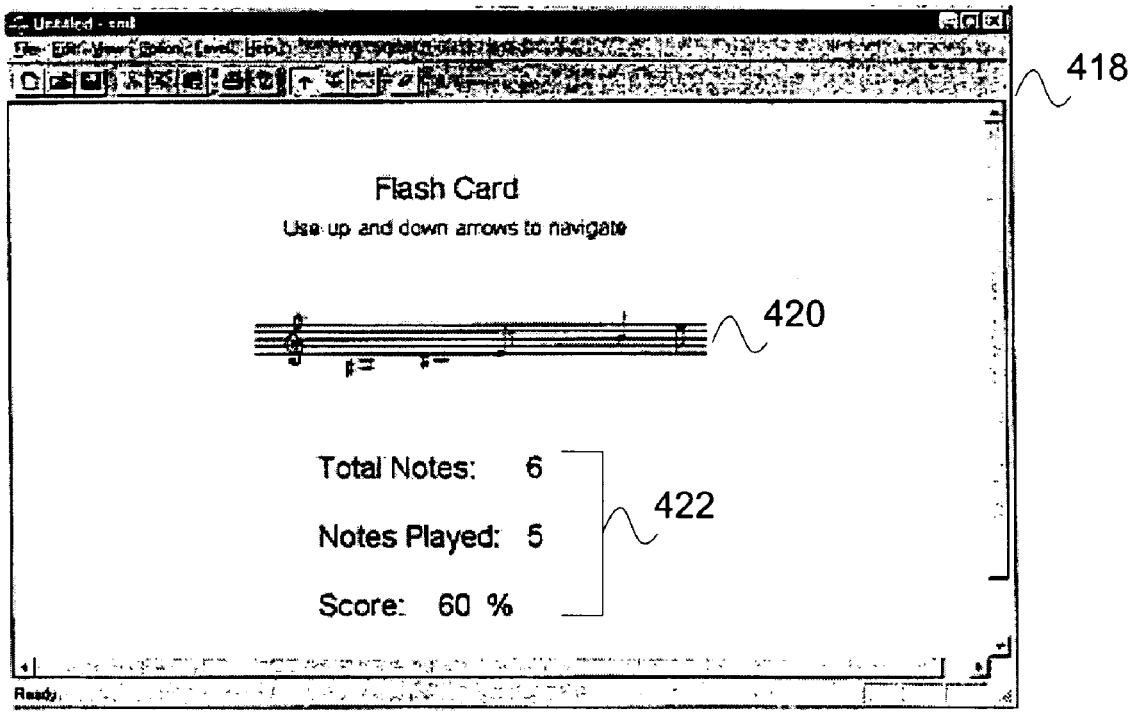

Play flash cards module 214 provides an interface for displaying a set of one or more flash cards that may be loaded into the system from a flash card file 220. A student may use those flash cards to learn how to play an instrument. After displaying the flash card on the screen by clicking Open Flash Card the sound card is read to receive notes. A red note shows a missed note, and a green note shows the correct note. The final result is shown at the bottom of the screen. In this mode, the user can upload flash cards. The user can either upload the ones already created, or choose from the built-in example flashcards. Once uploaded, the user can play to the displayed notes and at the end of each flash card; the user's performance may be measured as a percentage of correct notes. FIG. 4F illustrates an exemplary user interface screen 418 according to an embodiment of the invention.

Figure 3A:
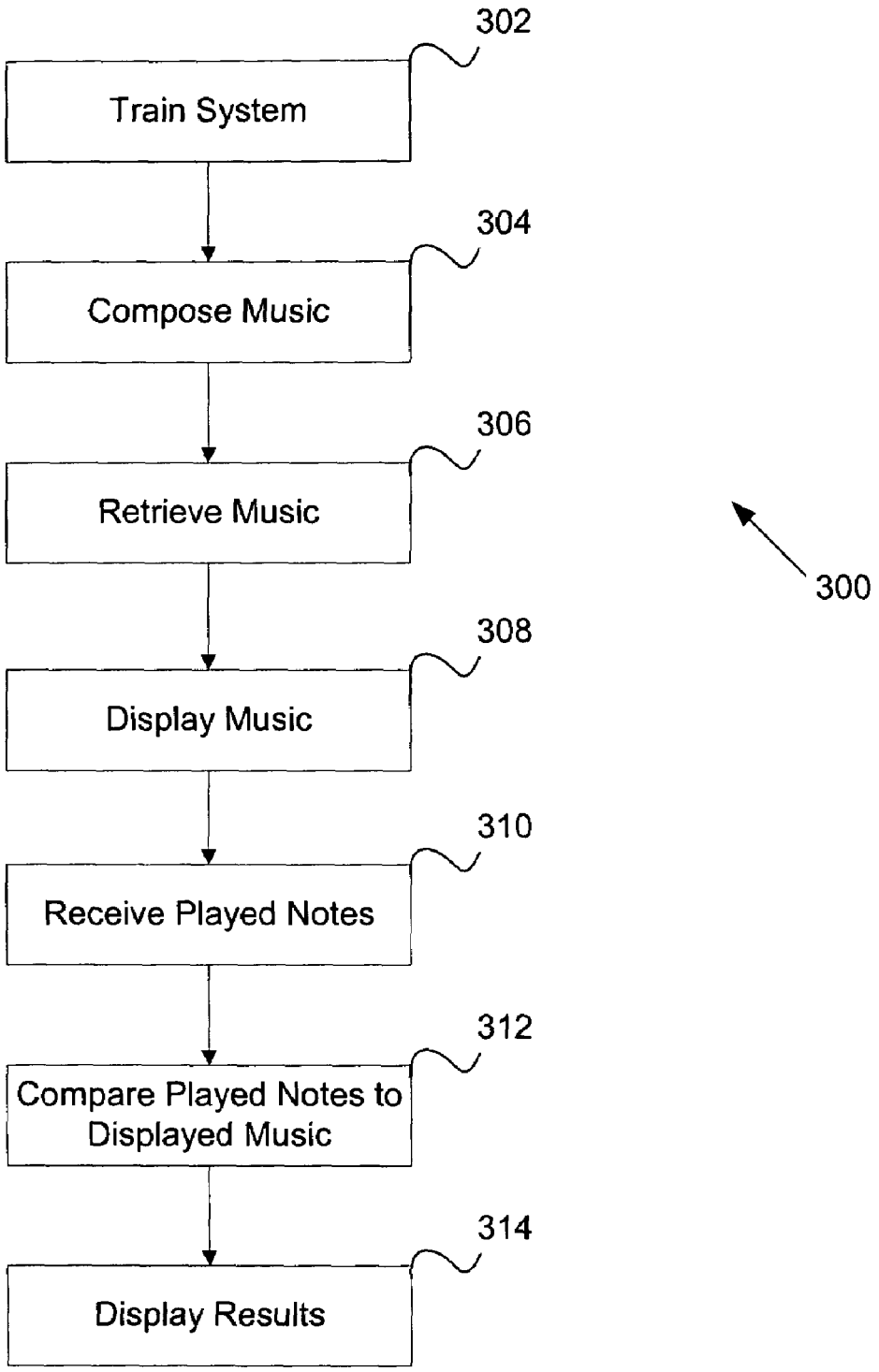
FIG. 3A is a flowchart illustrating a method for providing a computerized music tutor according to an embodiment of the invention.
Figure 3B:
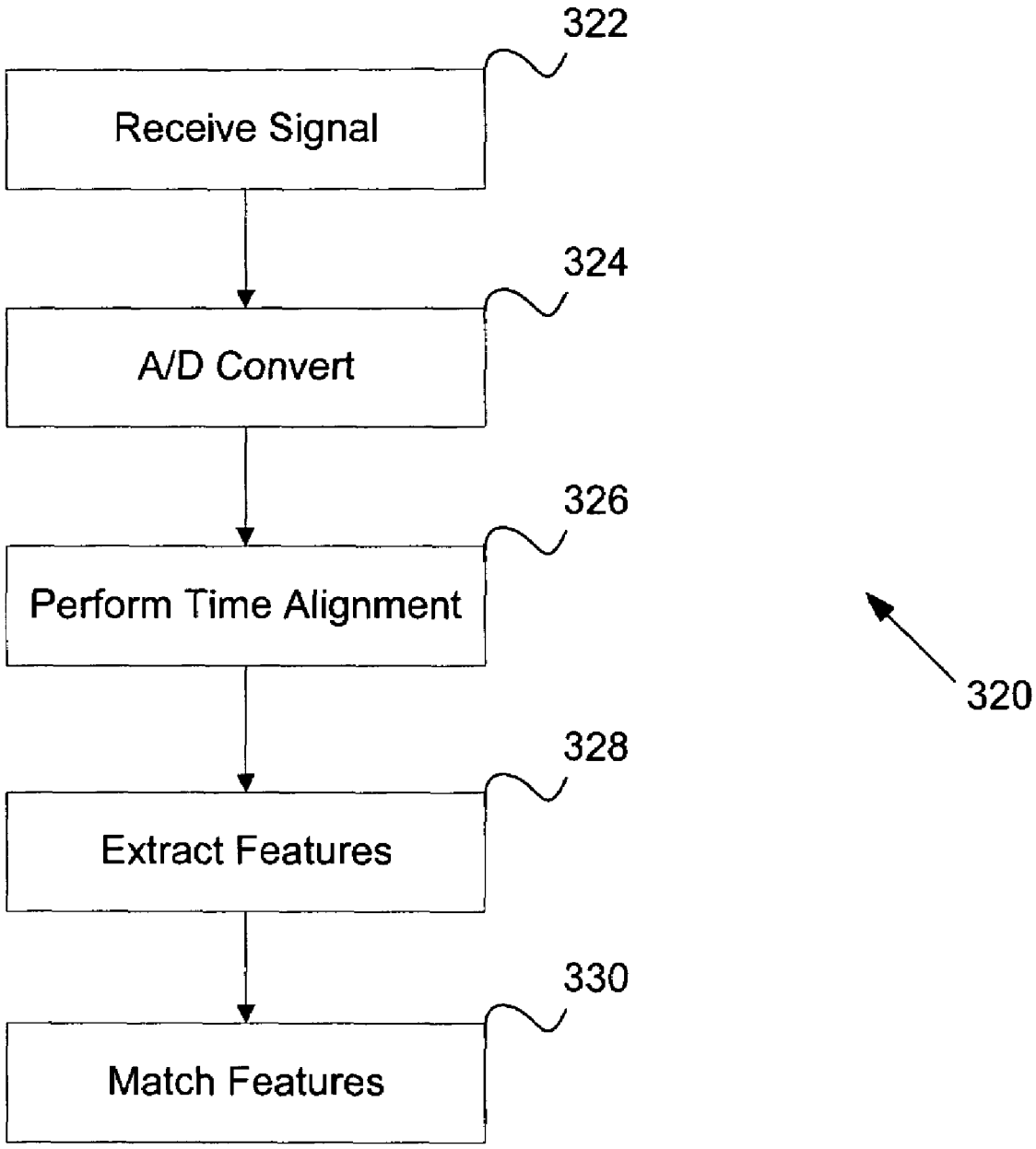
FIG. 3B is a flowchart illustrating a method for recognizing musical notes according to an embodiment of the invention.

FIGS. 3A and 3B are flowcharts illustrating methods for recognizing and processing music according to embodiments of the invention. The methods to be performed by the operating environment constitute computer programs made up of computer-executable instructions. Describing the methods by reference to a flowchart enables one skilled in the art to develop such programs including such instructions to carry out the methods on suitable computers (the processor or processors of the computer executing the instructions from computer-readable media). The methods illustrated in FIGS. 3A and 3B are inclusive of acts that may be taken by an operating environment executing an exemplary embodiment of the invention.

FIG. 3A is a flowchart illustrating a method for providing a computerized music recognition and tutoring system according to an embodiment of the invention. In one embodiment of the invention, the method begins by training a system executing the method to recognize a set of notes for a musical instrument (block 302). The training process includes recording the instrument's music note pattern. In some embodiments, a user is prompted to play a series of notes in a range. The user may be able to change the tuning range by modifying the first note and last note of the range through a user interface. After inputting the expected tuning range, the system is ready to be trained. In some embodiments, the system displays a window that shows the current note that needs to be trained into the system. For each input note, the program will show the information of this note and current status. In some embodiments, the user can find the current training note, the expected note frequency, the pattern of the note, and the tuning territory on the training user interface. The training interface prompts the user to play one note at a time until the user is satisfied with the training. In some embodiments, the user may confirm each note before the system proceeds further. In some embodiments, the user can choose "Next" to train for the next note, "Replay" to retrain for the current note or "Back" for a previous note. In some embodiments, if a user does not want to continue the training, a "Done" user interface element may be selected, and the rest of the note pattern in the tuning territory will be filled by default values. The program will continue until the last note in the tuning range is received.

Once a user is satisfied with the training set, the user may save training data in a training database. In some embodiments, the training database is a file. In alternative embodiments, a relational database or other database management system may be used.

In some embodiments, a default database is provided having a set of preset frequencies to recognize the user input. The default database may be stored in default pattern file that the system uses when loaded. In some embodiments, the default database is optimized for a piano. Thus in some embodiments, training the system is optional.

Next, the system retrieves music to be replayed (block 306). In some embodiments, the music comprises a set of reference notes for a musical segment. In alternative embodiments, the music comprises a set of one or more flash cards, where each flash card includes one or more reference notes.

The system then displays the music retrieved (block 308). In some embodiments, the music is displayed on a computer screen or LCD screen. In the case of a musical segment, there may be more notes than can fit on a display. In this case, the current notes are displayed and an interface may be provided to navigate through the music segment. In addition, various embodiments of the invention recognize notes played and automatically advance to the next set of notes as a user plays the musical segment.

Next, the system receives a played note (block 310). In some embodiments, the played note is received from a microphone attached to a sound card or A/D converter. In alternative embodiments, the system played note may be received through a digital interface such as a MIDI interface.

Next, the system compares the played note with a current note from the reference notes (block 312). Each time a new note arrives, it is compared with the first node in the linked list that has not been compared (i.e. the current note). In some embodiments, the played note must be recognized prior to comparison. FIG. 3B below provides further details on a method for recognizing notes according to embodiments of the invention. In some embodiments, pitch and timing information is compared.

In alternative embodiments, only timing information is compared when the instrument being played is a polyphonic instrument. In these embodiments, the time signature of the music gives the beats in a measure and tells what kind of notes will be received in a beat. A measure is a typically considered a group of beats containing a primary accent and one or more secondary accents. Based on the timing relation of a note, a measure, and the score, the system can tell the current measure being played. But there is often no way to tell which note in the measure is currently being played.

Next the system displays the result of the comparison (block 314). As described above, in some embodiments, the color of the note will be changed depending on whether the played note matched the current note. If there is a match, the note color for the current note changes from black to green. Otherwise, the color changes to red. In the case of a polyphonic instrument, where only timing information may be available, the color of the current measure rather than the current note is changed.

Various embodiments of the invention provide for comparisons at differing levels. As noted above, at a beginner level setting, the system will wait for the right note before it continues. That means when replaying a song, if a mistake is made, the system will turn a note red and keep it red until the right node is played. Then, the system will start comparing the input with the next note.

At the intermediate level setting, the system will turn a wrongly played note red, but will continue on to the next note for comparison. This means the user should not replay a note entered wrong, because now the program will have moved on to the next note on the screen. However, the intermediate setting will not account for timing issues on the note.

At an advanced level setting, the program may do the same processing as in the intermediate setting. In addition, it will account for note timing (i.e. a note displayed in ⅛th has to be replayed in ⅛th for the program to turn the note green).

It should be noted that color has been used to delineate unplayed notes, correctly played notes, and incorrectly played notes. In alternative embodiments of the invention, alternative forms of highlighting notes may be used and are within the scope of the invention. For example, various combinations of cross-hatching patterns, blinking, bolding and other highlighting mechanisms could be used instead of or in addition to color.

FIG. 3B is a flowchart illustrating a method for recognizing musical notes according to an embodiment of the invention. The method begins when a system executing the method receive a signal representing a played note (block 322). The signal may be an analog signal such as that received from a microphone in proximity to an instrument, or the signal may be a digital signal such as that received via a MIDI or other digital interface.

Next, if the input signal is an analog signal, the input signal is converted to digital, typically by an A/D converter (block 324). In some embodiments, a sampling rate of 11.025 KHz is used. Those of skill in the art will appreciate that other sampling rates could be used and are within the scope of the invention. All that is required is that the sampling rate be adequate to distinguish between different notes.

Figure 5A:
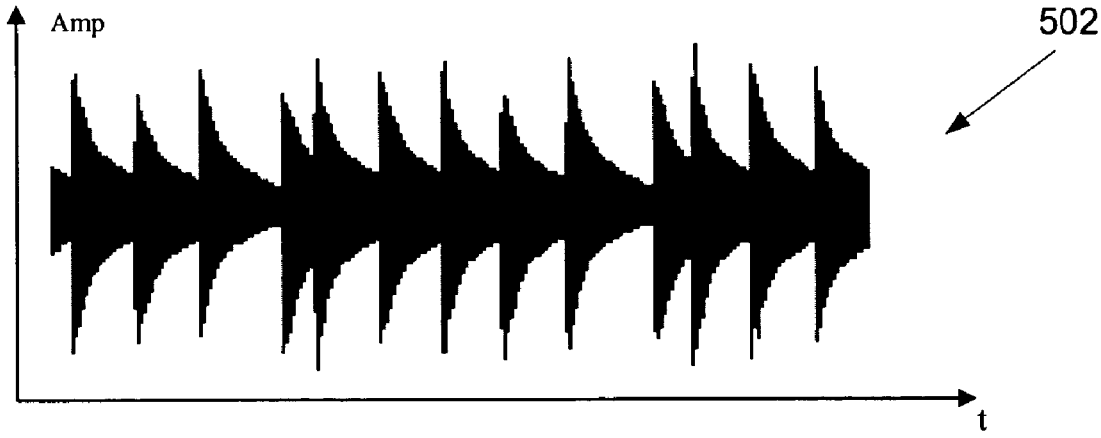
FIGS. 5A-5G are graphs illustrating characteristics of musical notes used to recognize musical notes in embodiments of the invention.
Figure 5B:
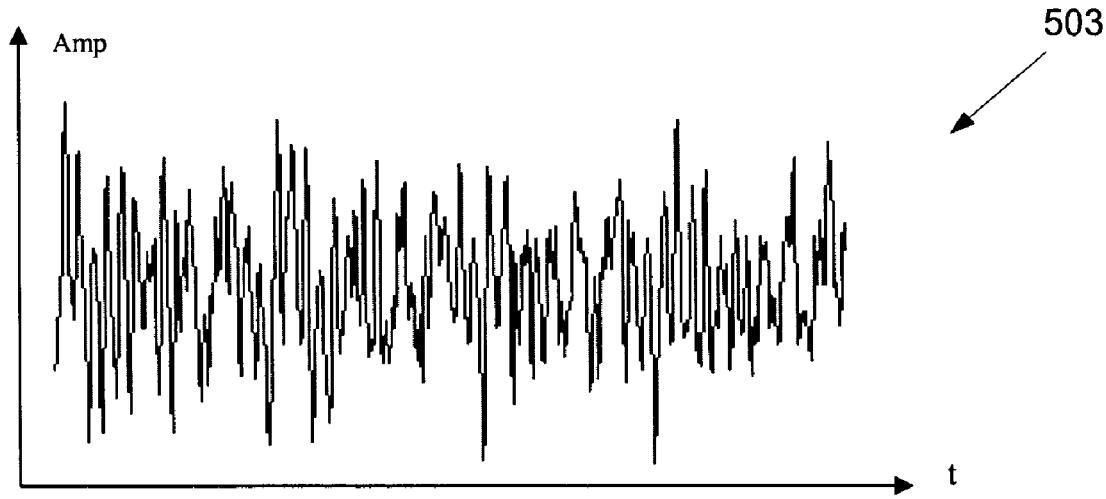

Next, the system performs time alignment on the digital data (block 326). For continuously played music, each note may potentially overlap the previous note or the next one. Therefore some embodiments of the invention identify the starting and ending edges of each note in the time domain. FIG. 5A illustrates part of a waveform 502 for a set of exemplary continuously played notes. As shown in FIG. 5A, the peak of the waveform may be considered as the start of a note. An expanded view of a note's waveform is showed in FIG. 5B. FIG. 5B illustrates that the waveform may change very fast. In general, to find the start point of a note, some embodiments use the sum of the square of amplitude during a predetermined time-window period W. This method can help find the start point by determining the peak of the sum. Moreover, if there is a single high amplitude noise pulse in the waveform, this method may suppress the influence of the noise. Thus, in some embodiments, the system calculates:

$$S_t = \sum_{i=t}^{t+W} Amp_i^2$$

Where, $S_t$ is the sum starting at time t, and W is the width of time-window, $Amp_i$ is the waveform amplitude at time i.

Because the square calculation is time consuming for a real time application, some embodiments perform and use the sum of the absolute amplitude (SAA) value instead of the sum of the amplitude square, i.e.:

$$S_t = \sum_{i=t}^{t+W} |Amp_i|$$

This reduces time complexity of the computation and typically takes about ½ of the time required to compute sum of the amplitude value on an MCS8031/51 micro-controller.

Figure 5C:
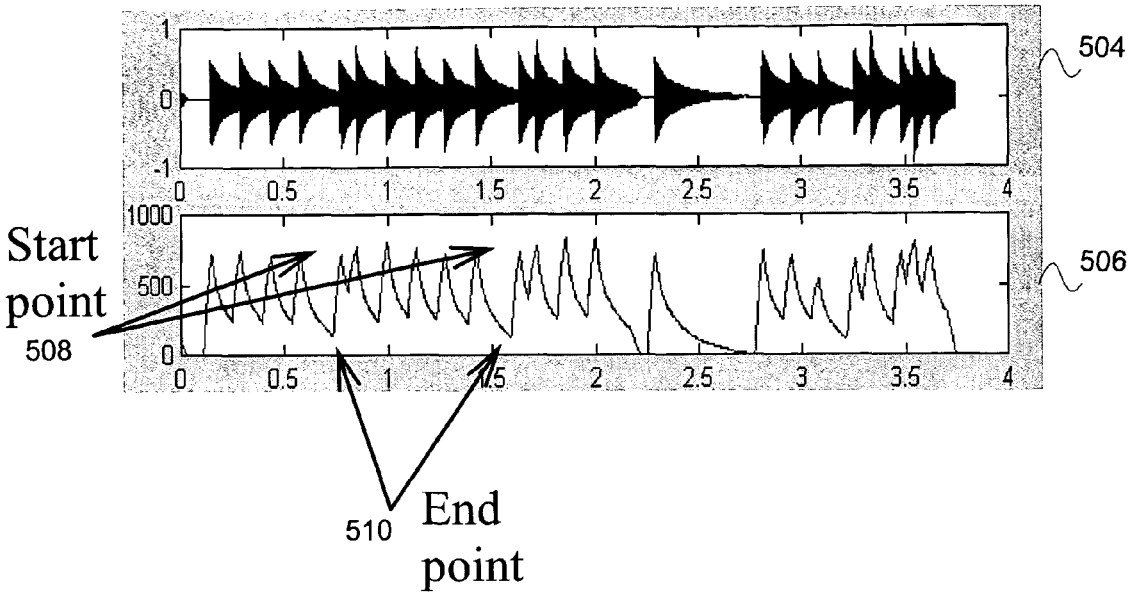

FIG. 5C shows the result of using sum of absolute amplitude value to determine each note's starting edge 508 in graph 506 for the notes' waveform represented in graph 504. If a $S_{MAX}=S_t$ is the peak value within a certain time window, then time t will be a note's starting time.

Various embodiments of the invention may use differing methods to determine the end point 510 of a note. One method used in some embodiments is to find $S_t$, which the minimum value between 2 peaks is. Another method used in alternative embodiments is to find a $S_t=S_{MAX}\times$threshold-ratio, where $S_{MAX}$ is the note's SAA value at the starting time and the threshold-ratio is the ratio between the starting point SAA value and the ending point SAA value. The second method may be problematic if two notes are played one after another in a very short time. As illustrated in FIG. 5C, each note's ending point SAA value is different from another's, thus it is hard to predict the threshold-ratio. A characteristic of the first method is that it takes a little bit more time in comparison to the second method, especially if the time gap between two notes is large. In some embodiments, the system determines that a SAA is the end point SAA if this SAA value is less than or equal to any following values of SAA during a certain time period. Appendix A-I provides pseudo-code for this calculation.

Returning to FIG. 3B, the system executing the method next extracts features from the played note (block 328). Feature extraction may also be referred to as pattern extraction. Each musical note typically has a particular feature characterized by a major frequency and multiple harmonic frequencies.

Figure 5D:
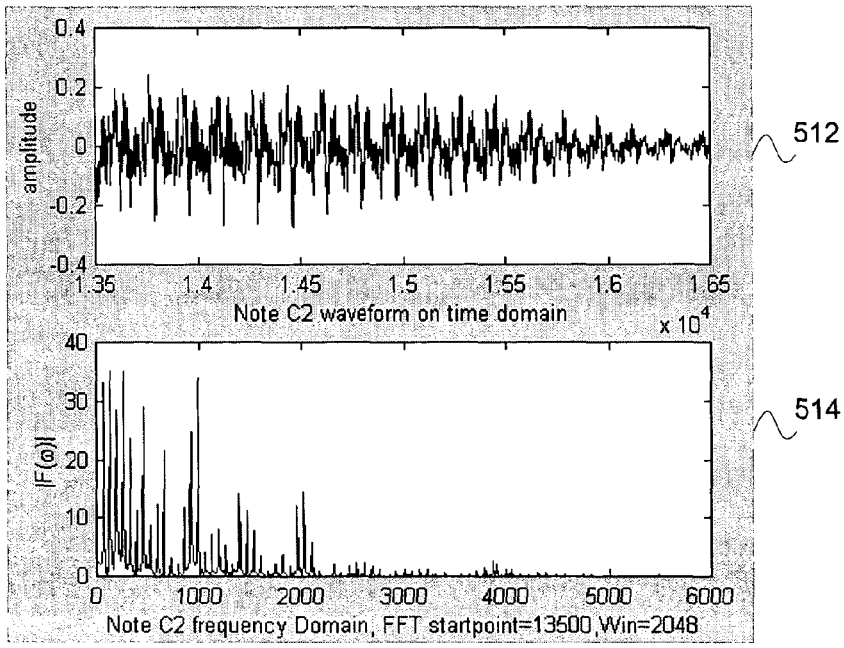

In order to extract features from the note, the system transforms the input data from the time domain to the frequency domain. In some embodiments, this is done by FFT. For example, FIG. 5D shows a note's frequency spectrum 512 using a 2048-point FFT at 11.025 KHz sampling rate.

Typically, the higher the number of points in the FFT the better is the frequency resolution that can be obtained. However, the computational time of FFT also increases dramatically with the number of sampled signals used for the FFT. For example, the number of computations required in an N-point FFT is of the order of O(N×log N) in terms of multiply-and-add operations. Thus for a 2048-point FFT, the computation may be about five times more expensive in terms of multiply-and-add operations than that for a 512-point FFT. Some embodiments of the invention are able to recognize a note whose duration period is as short as 0.125 second in real-time. As a result, some embodiments of the invention use an FFT with 256 points. Alternative embodiments use an FFT with 512 points. In these embodiments, it is desirable that the characteristics features 514 used to identify the frequency spectrum of a note should not be very sensitive to the frequency resolution. However, it is desirable that the difference between features of any two different notes should be as large as possible. Those of skill in the art will appreciate that a faster processor will support a higher number of points in the FFT and still be able to recognize notes in real time.

As mentioned earlier, in the low pitch range, the fundamental frequency of the music signal may be weaker than the harmonics. More over the harmonic may coincide for two notes, thus the system may not determine the pitch of the note only depending on its highest energy frequency peak. On the other hand, a note's frequency spectrum includes its fundamental frequency and the relevant harmonic frequency. This combination typically doesn't change much when the same note is played by an instrument. Different notes have different frequency combinations. The order of this combination can provide important information in identifying the note played. Another important thing to be noted is that the sound energy of a note is provided by some frequencies with high amplitude value, and the contribution of the other trivial frequencies is very little. Thus some embodiments identify notes by identifying significant frequencies for each note and recording their relative strength, thereby obtaining a unique frequency pattern for every note.

Figure 5E:
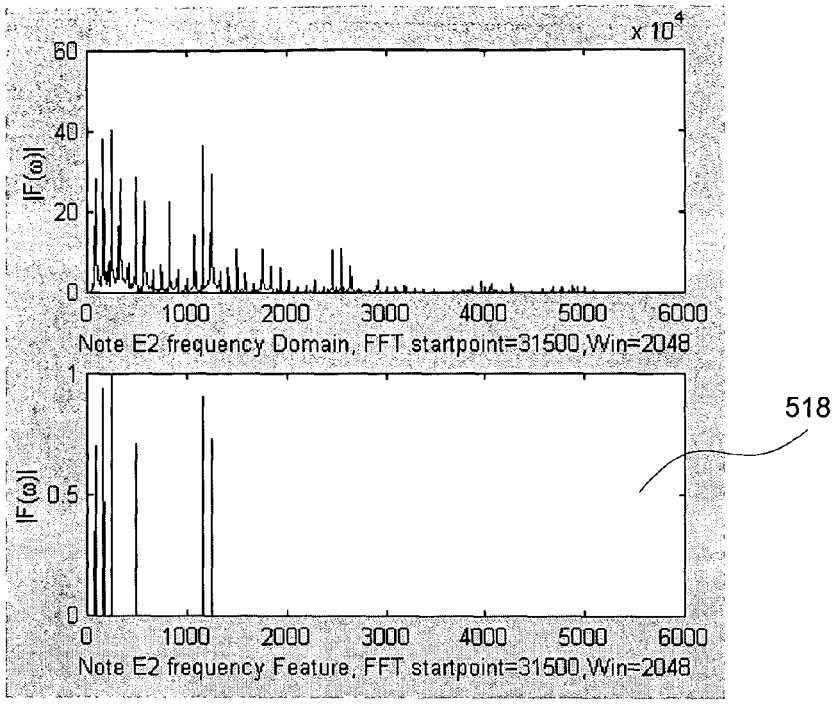

FIG. 5E illustrates that an exemplary frequency spectrum 516 is made of many peaks of different amplitude on different frequency points. For an analog signal, instead of some single frequency pulses, a note's frequency spectrum is commonly made of some frequency lobes with different widths and different peak values as illustrated in graph 518. Therefore it is desirable to find a few most important frequency lobes or the frequency lobes with highest peak values. Some embodiments use the peak value of the lobe and it's corresponding frequency location. This is called peak-frequency-location or frequency-position. In this specification, $V_i$ denotes the ith peak value, and $L_i$ denotes the corresponding peak frequency location. The pair $(V_i,L_i)$ will be referred to as a "feature point" which is denoted by $F_i$ $(V_i,L_i)$.

Various embodiments of the invention use more than one such feature point to identify a note. One reason, as mentioned earlier, is that in a low pitch range, the fundamental frequency of a note may be weaker than it's harmonic frequencies, and two different notes may have some of the same harmonic frequencies (e.g. 130 Hz is the harmonic frequency for both C1 and C2). Another reason for using more than one feature point is that based on a 11K Hz sampling frequency and a 256-point FFT, the frequency resolution is around 11K/256=43 Hz. This means if the difference between two frequencies is less than 43 Hz, the system may not distinguish them in frequency domain. However, the difference of some notes' fundamental frequencies is less than 43 Hz, for example, the fundamental frequency of C3 is 130 Hz, and the fundamental frequency of D3 is 146 Hz. Therefore, based on these reasons, a system may not properly identify a note from only one feature point; however a combination of more than one may be sufficient. In some embodiments, six such feature points are used to identify a note. Thus, the system selects six such feature points as part of the feature pattern of the note, and uses this feature point set to denote the feature pattern, i.e., $$\text{Feature Pattern: } P=\{F_i(V_i,L_i)|i=1, \ldots ,6\}$$

However, the invention is not limited to any particular number of feature points, and in alternative embodiments, fewer or more feature points may be used to identify a note.

Next, in some embodiments, the system arranges the feature point $F_i$ $(V_i,L_i)$ in decreasing order of its peak value $V_i$ and denote this arrayed pattern as:

$$P=\{F_i(V_i,L_i)|i=1, \ldots ,6, \text{ and } V_i>V_j, \text{ if } i<j.\}$$

Note that the feature points could be arranged in an alternative order, for example an increasing order.

Because one note can be played in different ways in different situations, the distribution of fundamental and harmonic energy may change from one playing to the next. This may lead to a different pattern at different times for the same note. In particular the note's peak values may be different. Therefore, in some embodiments, the chosen peak values are normalized with respect to the highest value instead of using the actual peak amplitude values.

As detailed above, a training database may be used wherein for a given instrument a calibration procedure is performed that identifies the key features of each note in a range of notes and stores them in a pattern database. The notes may be played one by one, their features analyzed, and stored in the database. The notes stored in the database may be referred to as the database notes. Appendix A-II shows the pseudo-code of this part.

After extracting features from the played note, the system executing the method proceeds to match the features of the played note with features of notes stored in a database (block 330). The feature matching (also referred to as pattern-matching) of the present invention uses the undetermined played note's features and compares them with patterns stored in a database in order to determine which note was played. Generally, because of possible background noise around instruments, interference introduced by previous notes and the position of the input devices, the feature pattern of a certain note played at one time may be different from the same note played at a different time. Therefore it is desirable that the pattern-matching algorithm take into account the differences. One aspect of the method of the present invention determines whether the two different patterns are the feature of the same note or not.

Figure 5F:
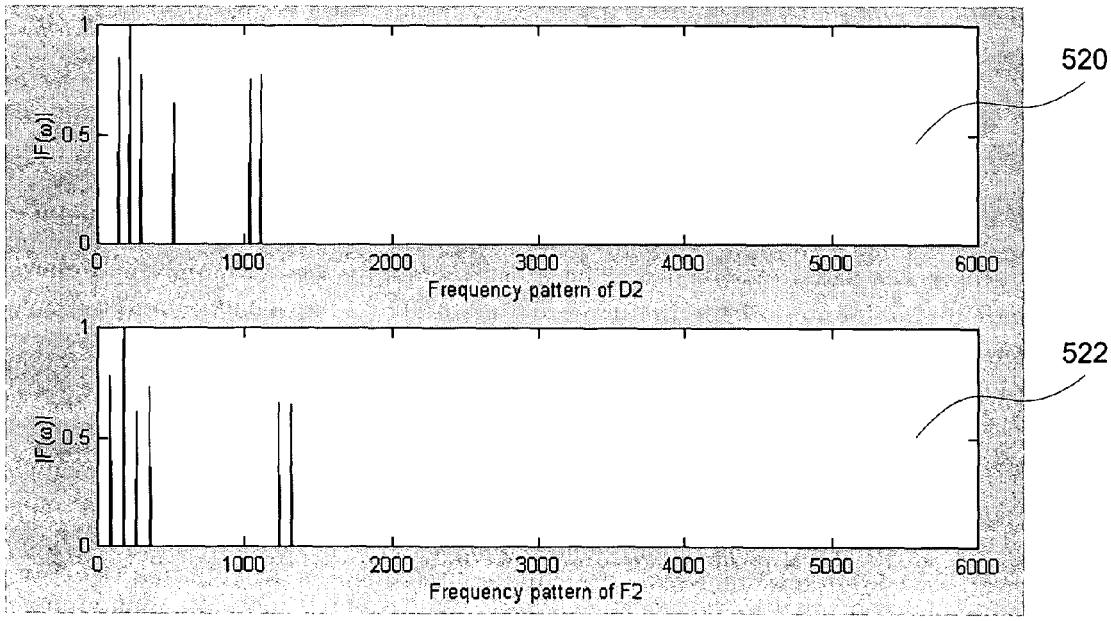
Figure 5G:
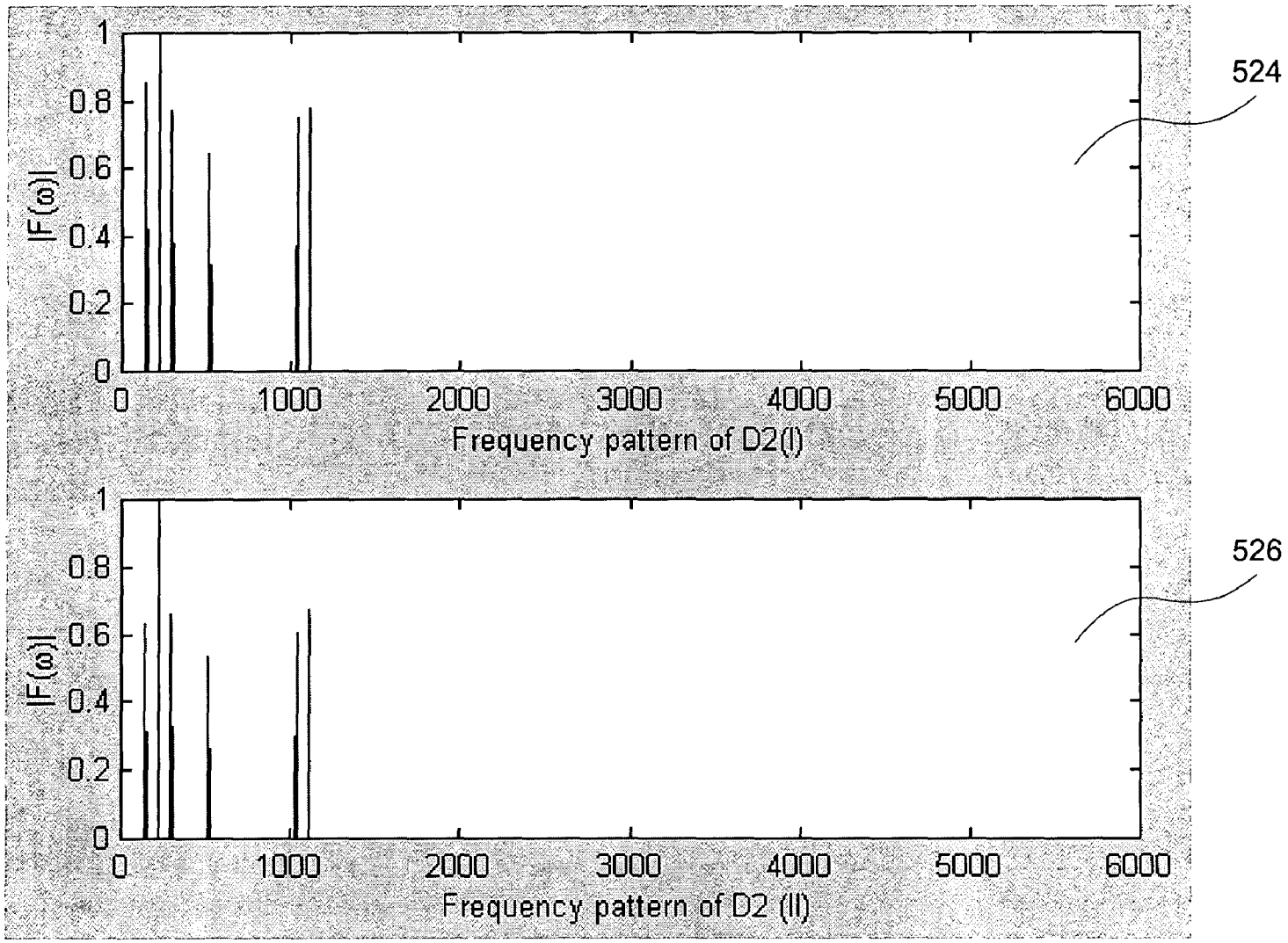

FIGS. 5F and 5G are further illustrations of feature patterns of exemplary notes. FIG. 5F illustrates a feature pattern of note D2 520 and a feature pattern of a different note F2 522. As illustrated in FIG. 5F, the frequency-patterns and difference between two different notes can be observed even when the two notes' pitches are close.

FIG. 5G illustrates the feature pattern of the same note, D2, sampled at two different points in time. The first time is illustrated in graph 524, and the second time in graph 526. Here it can be observed that even the patterns of the same note may be different at different times. In general, the peak values as well as frequency locations may be different for the two patterns of the same note played at different times.

However, although a certain note's frequency pattern may change at different times, as shown in FIG. 5G, the two patterns are still similar to each other when compared with the patterns of different notes, as shown in FIG. 5E. There are generally at least two reasons that introduce the difference. One is there may be additional noise that can introduce an unexpected peak in the note's frequency spectrum. Fortunately, the noise generally does not influence the high-energy peaks very much, although some lower frequency peaks maybe changed substantially. A second reason is due to the frequency lobe's changing shape. If the frequency lobe's envelope changes a little, the peak position will also change. Generally, the difference is around one or two points in frequency location.

Thus the various embodiments of the invention compare the pattern of an undetermined note to each note pattern stored in a database and choose the closest one as the final result. Since the peak value difference is typically more common than the frequency location difference, some embodiments use the peak value to compare notes. However, alternative embodiments use both the peak value and frequency location to compare notes. Further, various embodiments use different weights for the peak value and frequency location. In these embodiments, weights $W_{f,d}$ are used for frequency location difference, which changes with the difference value d of frequency locations, $$W_{f,d} = \begin{cases} k_1, & d = 1 \\ k_2, & d = 2 \\ \ldots & \\ \infty, & d > \text{threshold} \end{cases}$$

and weights $W_V$ are used for peak value difference. The set of weightings may vary depending on the environment in which the musical instrument is played, and the type of musical instrument being played, and are typically established during the training process described above.

Recall that $F_j$ $(V_j,L_j)$ denotes jth feature point of a note's pattern. Some embodiments of the invention use the following difference formula between the undetermined input note pattern and the database pattern. $DP_i$ denotes the difference between the undetermined input note pattern and the pattern of note i in database:

$$DP_i = \sum_{j=1}^{6} W_V \times DV_j \times W_{f,DL_j}$$

Where, $DL_j$ is the frequency location difference of the undetermined note's jth feature point to the corresponding feature point's frequency location of database note i, $DV_j$ is the value difference for the same points, and $W_{f,DL_j}$ denotes the weight for difference value of the jth frequency location. The closest feature point is referred to as the matching feature for the undetermined note's jth feature. $W_{f,DL_i}$ and $W_v$ may be adjusted experimentally and according to the application.

When determining whether an undetermined note matches a database note, there are generally two different scenarios involved when attempting to determine a matching feature point i for the undetermined note'sjth feature point.

Scenario I: One of the six feature points in database note i has a frequency location which is the same as the frequency location of the undetermined note'sjth feature point, or the difference of these two frequency locations is less than a predetermined threshold. In some embodiments, the method uses $M_j$ to denote this feature point. So, in this scenario:

$$|L_j - L_{M_j,i}| = \min_{\substack{k\in\{1,\ldots,6\},\\ k\neq M_s, s<j}} |L_j - L_{k,i}| < \text{threshold}$$

Where, $L_{M_j,i}$, $V_{M_j,i}$ are the frequency location and the value of the ith note's $M_j$th feature point. If the $M_j$th feature point has already been selected as a matching feature to the undetermined note's jth feature point, then the system can't use it to be the matching feature for another feature point of the undetermined note. Therefore some embodiments of the invention utilize a restriction of $k\neq M_s, s<j$ Thus in this situation, $$DL_j=|L_j-L_{M_j,i}|+1$$

$$DV_j=|V_j-V_{M_j,i}|.$$

Scenario II:

In the second scenario:

$$|L_j - L_{M_j,i}| = \min_{\substack{k\in\{1,\ldots,6\},\\ k\neq M_s s<j}} |L_j - L_{k,i}| > \text{threshold}$$

This means that the system cannot find a matching a matching feature in ith database note for the undetermined played note's jth feature. In this situation:

$$DL_j=\text{threshold}+1,$$

$$DV_j=|V_j|.$$

In various embodiments, in order for two notes to be considered the same note, there should be at least 4 pattern points that match between the two notes. Thus in some embodiments, if there are more than 2 pattern points of the undetermined note not matching to the ith database note, then the ith database note is not considered a matching result.

After comparing the undetermined played note with all notes in the database, the system chooses kth note such that:

$$DP_k = \min_{i\in\{database\}} DP_i$$

Thus note k is the match result for the input undetermined note. Appendix A-III shows the pseudo-code of this part.

Figures 6A, 6B:
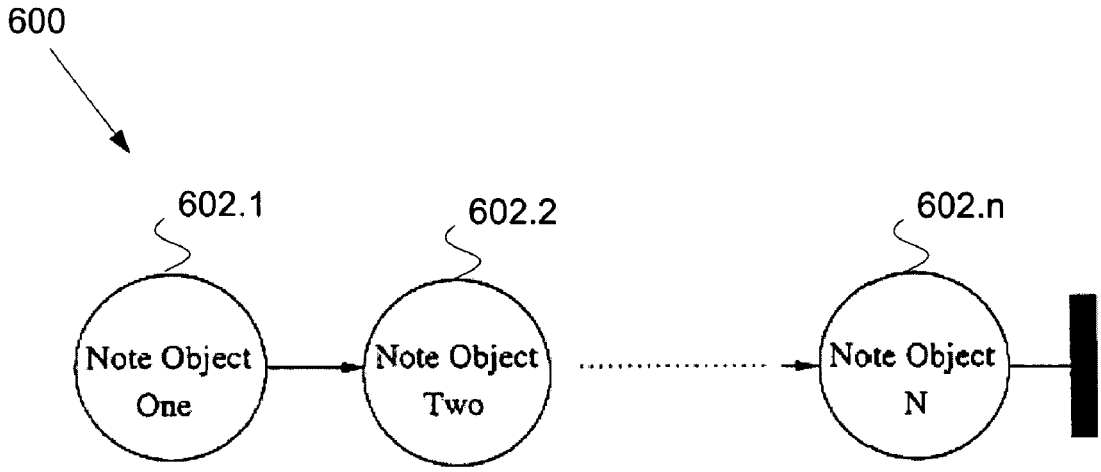
FIGS. 6A and 6B are illustrations of exemplary data structures used in various embodiments of the invention.

FIGS. 6A and 6B illustrate an exemplary data structure according to various embodiments of the invention. The exemplary data structure illustrated in FIG. 6A shows the basic characteristics used to represent music notes that have been extracted, and shows the data part of a note object. Various attributes, such as pitch and duration are attached to a note. These attributes define how a note should be played.

In some embodiments, a linked list 600 is used to store the note objects as illustrated in FIG. 6B. A linked list is desirable, because it is relatively easy to use, and because a linked list can represent the sequential property of a music stream. For a music score including both treble and bass clefs, some embodiments of the invention use two linked lists to store bass and clef score. However, those of skill in the art will appreciate that other data structures could be substituted, such as an array, a table, or other data structure known in the art that is capable of representing multiple data objects.

Returning to FIG. 6A, the variable position may be a compound variable containing x-position and y-position information. It may be used to specify the place to put the note on the screen. Providing such position information may be used to minimize how often the screen needs to be updated. Without a note position, a whole page of notes typically has to be repainted any time the screen needs to be updated. A screen update happens whenever a new note arrives, a page turns over, or another window screen moves over the display. If a serial stream of notes arrives, the screen is updated many times in a very short time. The result of the frequent update may be a flashing screen. By utilizing the variable position, some embodiments of the invention only update the area around the note instead of the whole screen when a new note arrives. This can reduce the number of screen updates that occur.

Additionally, the structure of a linked list provides an easy way to follow live music. Each node in the list represents a music note which has been played or is waiting to be played. After the system is on, each time a new note arrives, it is compared with the first node in the linked list that has not been compared. In some embodiments, after comparison, the color of the note will be changed depending on whether it's a match or not. If a match happens, the note color changes from black to green. Otherwise, the color changes to red. By looking at the first node in the linked list which has black color, the system can readily tell the current position of the performance.

The linked list can also aid in following a polyphonic instrument. However, instead of using the nodes in the linked list to trace the performance, the timing information in an incoming note is used to follow a live presentation. After a score is loaded into the computer memory, the time signature of the music gives the beats in a measure and tells what kind of notes will be expected in a beat. A measure is a group of beats containing a primary accent and one or more secondary accents. Based on the timing relation of a note, a measure, and the score represented in the linked list, the system can tell the current measure being played, even if the system is unable to detect which note in the measure is currently being played.

CONCLUSION

Systems and methods for recognizing music have been disclosed. The systems and methods described provide advantages over previous systems. The systems and methods display stored music, recognize and match in real time or near real time the notes played, and show the notes on a display device in sheet music form. The system can be trained to work with any instrument without using expensive special hardware peripherals. The systems and methods of the invention may be applied to music recording, music instruction, a training tool, an electronic music stand, and performance evaluation.

Although specific embodiments have been illustrated and described herein, it will be appreciated by those of ordinary skill in the art that any arrangement which is calculated to achieve the same purpose may be substituted for the specific embodiments shown. For example, a composer can create compositions by just playing the instrument without writing down a single note. The final rendition of the composition can be immediately seen on a display device. The system can also be used in the recording industry, where a recording engineer can monitor the recorded music performance in real time and make modifications accordingly. This application is intended to cover any adaptations or variations of the present invention.

The terminology used in this application is meant to include all of these environments. It is to be understood that the above description is intended to be illustrative, and not restrictive. Many other embodiments will be apparent to those of skill in the art upon reviewing the above description. Therefore, it is manifestly intended that this invention be limited only by the following claims and equivalents thereof.

Appendix A

I: Pseudo-Code of Time Alignment

Parameter:

$W_1$: number of sampling data that need to be sum up.

$W_2$: window size used to determine if the point is the starting point or ending point.

$S_i$: Sum of the sampling data amplitudes from point i-$W_1$ to point i.

Initialization:

$$\text{Max} = 0,\ \text{counter} = 0,\ \text{Min} = 1000,\ S_{W_1} = \sum_{i=1}^{W_1} |Amp_i|.$$

Pseudo-Code:

```
S_i = S_{i-1} +|Amp_i|-|Amp_{i-W_1-1}|
if {looking-for-label = starting point}, then
    {
    if S_i >Max, then
        Max= S_i, counter=0;
    Else { counter=counter+1;}
    if counter > W_2 then
        { starting point = i, Max=0, counter=0, looking-for-label =
        ending point;}
    }
Else
    {
    if S_i <Min, then
        { Min= S_i, counter=0;}
```

-continued

```
Else{ counter=counter+1;}
    If counter > W_2 then
        { ending point = i, counter=0, Min=1000, looking-for-label =
        starting point;}
    }
return;.
```

II. Feature Extraction

Parameter:

$W_{FFT}$: FFT point number $P_k$: kth frequency pattern. Each pattern includes 2 parameters: point's frequency-position and its frequency-amplitude value $V_i$: the frequency-amplitude-value of frequency point i Pseudo-Code:

```
Use FFT to transfer W_FFT sampling points from time domain into frequency domain and
record V_i, i∈ (1, W_FFT).
For k=1 to 6
{
    find the max frequency-amplitude-value V_j in all W_FFT points,
    let P_k.value=V_j, P_k.frequency-position=j;
    V_j=0;
    i=1;
    while (point j+i and j−i∈lobe points of point j)      //suppress the lobe points' value
    except the peak one
    {V_{j+i} =0, V_{j−i} =0, i=i+1;}
}
For k=2 to 6 //normalize
{
    P_k.value= P_k.value / P_1.value;
}
P_1.value=1;
return { P_1, P_2, ... , P_6}
```

III: Pseudo-Code of Feature Match

Parameter:

$PD_i$: ith note pattern in database

PE: the pattern of the determining note $W_F$: the weight for frequency difference $W_v$: the weight for value difference Pseudo-Code:

```
Min=infinite;
Note=0;
while(the note pattern database is not finished yet)
{
    D=0;
    read the ith note's pattern PD_i from database;
    for(j=1 to total-number-of-frequency-pattern)
    {
        for(k=1 to total-number-of-frequency-pattern)
        {
        if(| PE.jth-frequency-position - PD_i.kth- frequency-position |
        <frequency-different-threshold) then
            { F_j =| PE.jth-frequency-position - PD_i.kth-
            frequency-position|+1;
            V_j=| PE .jth-value - PD_i.kth-value|;
            D=D+W_F*F_j*W_v*V_j;
            Break;
            }
        }
        if (PE 's jth-frequency-pattern can't find a matched pattern
        in PD_i) then
```

-continued

```
            { different-pattern-number= different-pattern-number+1;}
        if(different-pattern-number>pattern-different-threshold) then
            {D=infinite, goto step 1;}
    }
    if D<Min then
        {Min=D
        Note=i;
        }
step 1: i=i+1;
}
return Note;
```

We claim:

1. A computerized method for recognizing music, the method comprising:

receiving an input data representing a played note;

performing time alignment on the input data;

extracting features from the input data;

weighting at least a subset of the features; and comparing according to the weighting the extracted features to a dataset of saved note features to determine a matching note;

wherein a match occurs when at least a subset of the extracted features match a note in the dataset of save note features.

2. The method of claim 1, wherein the input data is analog data and further comprising performing an analog to digital conversion of the input data.

3. The method of claim 1, wherein performing time alignment include performing a FFT on the input data.

4. The method of claim 3, wherein the FFT comprises a 512 point FFT.

5. The method of claim 1, wherein the played note matches the saved note if at least four of note features for the played note match a set of six note features for the saved note.

6. The method of claim 5, wherein the set of note features includes a fundamental frequency.

7. The method of claim 5, wherein the set of note features includes note-duration.

8. The method of claim 5, wherein the set of note features includes at least one harmonic frequency.

9. The method of claim 8, wherein the set of note features includes at least 5 harmonic frequencies.

10. The method of claim 5, wherein the set of note features includes at least one peak location and at least one peak value.

11. The method of claim 10, wherein the comparing includes weighting the at least one peak location and the at least one peak value.

12. The method of claim 1, wherein performing time alignment includes determining a start point and an end point of a note in the input data.

13. The method of claim 12, wherein a sum of the square of the amplitude is used to determine the start point.

14. The method of claim 12, wherein the sum of the absolute amplitude is used to determine the staff point.

15. A computerized method for providing a music tutor, the method comprising:

training a system to recognize a set of notes played by a musical instrument from one or more reference notes played by the same musical instrument;

retrieving a set of musical data comprising one or more reference notes;

displaying at least a portion of the set of musical data, said portion including a current note from the one or more reference notes;

receiving a played note;

comparing the played note to the current note; and displaying an indication of whether the played note matches the current note.

16. The computerized method of claim 15, wherein displaying an indication changes the color of the reference note in accordance with whether the played note matched the reference note.

17. The computerized method of claim 15, further comprising composing the set of reference notes.

18. The computerized method of claim 15, wherein the reference notes are included on a flash card.

19. The computerized method of claim 15, wherein the reference notes are included on a musical segment.

20. The computerized method of claim 15 wherein displaying an indication of whether the played note matches the current note includes highlighting correctly played notes in a first highlight and highlighting incorrectly played notes in a second highlight.

21. The computerized method of claim 20, wherein the first highlight is a first color and the second highlight is a second color.

22. The computerized method of claim 20, wherein the first highlight is a first cross-hatching and the second highlight is a second cross-hatching.

23. A computerized system comprising:

a processor and a memory coupled to the processor;

an analog to digital (A/D) converter coupled to the processor;

a sound input device coupled to the A/D converter;

a database; and a display;

wherein the analog to digital converter is operable to receive sound input from the sound input device and wherein the processor is operable to:

receive a set of data from the A/D converter, said data representing at least one note, extract note features from the set of data, applying a weighting to at least a subset of the note features, and identify the note based on matching the data representing at least one note to the set of database data, said identification occurring in near real-time, wherein a match occurs when at least a subset of the extracted features match a note in the dataset of saved note features.

24. The system of claim 23, wherein the A/D converter is included in a sound card.

25. The system of claim 23, wherein the sound input device is a microphone.

26. The system of claim 23, wherein the sound input device is a MIDI compatible device.

27. The system of claim 23, wherein the display is an LCD (Liquid Crystal Display).

28. The system of claim 23, wherein the processor is further operable to output a musical segment comprising at least one note to the display.

29. The system of claim 23, wherein the processor, the memory, the A/D converter and the display are incorporated on a single board computer.

30. The system of claim 23, wherein the processor, the memory, the A/D converter and the display are incorporated in a personal computer.

31. A computer-readable medium having computer-executable instructions for performing a method for recognizing music, the method comprising:

receiving an input data representing a played note;

performing time alignment on the input data;

extracting features from the input data;

weighting at least a subset of the features; and comparing according to the weighting the extracted features to a dataset of saved note features to determine a matching note;

wherein a match occurs when at least a subset of the extracted features match a note in the dataset of saved note features.

32. The computer-readable medium of claim 31, wherein the input data is analog data and wherein the method further comprises performing an analog to digital conversion of the input data.

33. The computer-readable medium of claim 31, wherein performing time alignment include performing a FFT on the input data.

34. The computer-readable medium of claim 33, wherein the FFT comprises a 512 point FFT.

35. The computer-readable medium of claim 31, wherein the played note matches the saved note if at least four of note features for the played note match a set of six note features for the saved note.

36. The computer-readable medium of claim 35, wherein the set of note features includes a fundamental frequency.

37. The computer-readable medium of claim 35, wherein the set of note features includes note-duration.

38. The computer-readable medium of claim 35, wherein the set of note features includes at least one harmonic frequency.

39. The computer-readable medium of claim 38, wherein the set of note features includes at least 5 harmonic frequencies.

40. The computer-readable medium of claim 35, wherein the set of note features includes at least one peak location and at least one peak value.

41. The computer-readable medium of claim 40, wherein the comparing includes weighting the at least one peak location and the at least one peak value.

42. The computer-readable medium of claim 31, wherein performing time alignment includes determining a start point and an end point of a note in the input data.

43. The computer-readable medium of claim 42, wherein a sum of the square of the amplitude is used to determine the start point.

44. The computer-readable medium of claim 42, wherein the sum of the absolute amplitude is used to determine the start point.

45. A computer-readable medium having computer-executable instructions for performing a method for providing a music tutor, the method comprising:

training a system to recognize a set of notes played by a musical instrument to create one or more reference notes played by the same musical instrument;

retrieving a set of musical data comprising one or more reference notes;

displaying at least a portion of the set of musical data, said portion including a current note from the one or more reference notes;

receiving a played note;

comparing the played note to the current note; and displaying an indication of whether the played note matches the current note.

46. The computer-readable medium of claim 45, wherein displaying an indication changes the color of the reference note in accordance with whether the played note matched the reference note.

47. The computer-readable medium of claim 45, further comprising composing the set of reference notes.

48. The computer-readable medium of claim 45, wherein the reference notes are included on a flash card.

49. The computer-readable medium of claim 45, wherein the reference notes are included on a musical segment.

50. The computer-readable medium of claim 45 wherein displaying an indication of whether the played note matches the current note includes highlighting correctly played notes in a first highlight and highlighting incorrectly played notes in a second highlight.

51. The computer-readable medium of claim 50, wherein the first highlight is a first color and the second highlight is a second color.

52. The computer-readable medium of claim 50, wherein the first highlight is a first cross-hatching and the second highlight is a second cross-hatching.

53. A computerized system comprising:

a database having a set of data representing at least one database note;

a sound input interface;

a pattern matching module coupled to the database and the sound input interface and operable to compare a set of data representing at least one played note with the set of data representing the at least one musical note and to identify the played note, the identification comprising applying a weighting to at least a subset of a set of note features in the set of data and performing a comparison of the weighted set of note features of the at least one played note to the set of data representing the at least one musical note;

a compose segment module operable to receive the identified played note and to output the played note.

54. The computerized system of claim 53, wherein the compose segment module outputs the played note to a display.

55. The computerized system of claim 53, wherein the compose segment modules is operable to output the played note to a music file.

56. The computerized system of claim 55 wherein the music file is a flash card file.

57. The computerized system of claim 53, further comprising a playback module operable to read a music file and to display a set notes in the music file.

58. The computerized system of claim 57, wherein the set of notes are displayed as a flash card.

59. The computerized system of claim 57, wherein the playback module receives data representing at least one played note from the pattern matching module and compares the at least one played note to the set of notes in the flash card file.

60. The computerized system of claim 59, wherein the playback module identifies whether the at least one played note was played correctly.

61. The computerized system of claim 59, wherein the playback module maintains statistics on a number of correctly played notes.

* * * * *

UNITED STATES PATENT AND TRADEMARK OFFICE

CERTIFICATE OF CORRECTION

PATENT NO. : 7,323,629 B2
APPLICATION NO. : 10/622083
DATED : January 29, 2008
INVENTOR(S) : Somani et al.

It is certified that error appears in the above-identified patent and that said Letters Patent is hereby corrected as shown below:

Sheet 14 of 14, in Fig. 6A, line 4, delete “sharp ;” and insert -- sharp; --, therefor.

In column 4, line 35, after “Windows 2000®” insert -- , --.

In column 14, line 54, delete “ $W_{f,DL_i}$ ” and insert -- $W_{f,DL_j}$ --, therefor.

In column 14, line 60, delete “note’sjth” and insert -- note’s jth --, therefor.

In column 14, line 64, delete “note’sjth” and insert -- note’s jth --, therefor.

In column 15, line 13, after “s<j” insert -- . --.

In column 15, line 23, delete “ $k \neq M_s s<j$ ” and insert -- $k \neq M_s, s<j$ --, therefor.

In column 18, line 65, delete “PE ’s” and insert -- PE’s --, therefor.

In column 19, line 26, in Claim 1, delete “save” and insert -- saved --, therefor.

In column 19, line 60, in Claim 14, delete “staff” and insert -- start --, therefor.

In column 20, line 43, in Claim 23, delete “applying” and insert -- apply --, therefor.

UNITED STATES PATENT AND TRADEMARK OFFICE

CERTIFICATE OF CORRECTION

PATENT NO. : 7,323,629 B2
APPLICATION NO. : 10/622083
DATED : January 29, 2008
INVENTOR(S) : Somani et al.

It is certified that error appears in the above-identified patent and that said Letters Patent is hereby corrected as shown below:

In column 22, line 50, in Claim 57, delete “set notes” and insert -- set of notes --, therefor.

Signed and Sealed this

Twenty-fourth Day of February, 2009

John Doll

JOHN DOLL
*Acting Director of the United States Patent and Trademark Office*

UNITED STATES PATENT AND TRADEMARK OFFICE

CERTIFICATE OF CORRECTION

PATENT NO. : 7,323,629 B2
APPLICATION NO. : 10/622083
DATED : January 29, 2008
INVENTOR(S) : Somani et al.

It is certified that error appears in the above-identified patent and that said Letters Patent is hereby corrected as shown below:

On the face page, in column 1, below "Inventors" insert -- (73) Assignee: Iowa State University Research Foundation, Inc., Ames, IA (US) --.

Signed and Sealed this
Twenty-eighth Day of December, 2010

David J. Kappos

David J. Kappos
*Director of the United States Patent and Trademark Office*